US005815776A

United States Patent [19]

Nukada

[11] Patent Number: 5,815,776

[45] Date of Patent: Sep. 29, 1998

[54] ELECTROPHOTOGRAPHIC APPARATUS WITH PHOTORECEPTOR HAVING UNDERCOAT LAYER, CONTAINING AN ELECTRONIC TRANSPORTING PIGMENT AND REACTIVE ORGANOMETALLIC COMPOUND

[75] Inventor: Hidemi Nukada, Minami-ashigara, Japan

[73] Assignee: Fuji Xerox Co., Ltd., Tokyo, Japan

[21] Appl. No.: 854,345

[22] Filed: May 12, 1997

Related U.S. Application Data

[62] Division of Ser. No. 561,231, Nov. 21, 1995, Pat. No. 5,658,702.

[30] Foreign Application Priority Data

Nov. 22, 1994 [JP] Japan ..... 6-311332

[51] Int. Cl.[6] ..... G03G 15/02

[52] U.S. Cl. ..... 399/174; 399/159

[58] Field of Search ..... 430/58, 62, 131; 399/159, 174

[56] References Cited

U.S. PATENT DOCUMENTS

| | | | |
|---|---|---|---|
| 5,008,706 | 4/1991 | Ohmori et al. | 399/174 |
| 5,168,024 | 12/1992 | Yamamoto et al. | 430/58 |
| 5,270,141 | 12/1993 | Ohtani et al. | 430/62 |
| 5,363,176 | 11/1994 | Ishihara et al. | 399/176 |
| 5,389,477 | 2/1995 | Tsuchiya et al. | 430/58 |
| 5,393,629 | 2/1995 | Nukada et al. . | |

FOREIGN PATENT DOCUMENTS

| | | |
|---|---|---|
| 48-47332 | 7/1948 | Japan . |
| 51-114132 | 10/1951 | Japan . |
| 52-42123 | 4/1952 | Japan . |
| A-58-209751 | 12/1983 | Japan . |
| A-59-23439 | 2/1984 | Japan . |
| A-59-160147 | 9/1984 | Japan . |
| A-60-218655 | 11/1985 | Japan . |
| A-61-80158 | 4/1986 | Japan . |
| B2-61-35551 | 8/1986 | Japan . |
| A-62-284362 | 12/1987 | Japan . |
| A-63-210848 | 9/1988 | Japan . |
| A-01 252 967 | 10/1989 | Japan . |
| A-02 300 759 | 12/1990 | Japan . |
| A-05 273 780 | 10/1993 | Japan . |
| A-61-204640 | 9/1996 | Japan . |

OTHER PUBLICATIONS

Derwent Publications Ltd., London, GB:: AN 95–071184, 1 pg.

*Primary Examiner*—Christopher D. Rodee
*Attorney, Agent, or Firm*—Oliff & Berridge, PLC

[57] ABSTRACT

A negative-electrification type electrophotographic photoreceptor which has an undercoat layer slightly soluble or insoluble in solvents and retains stable properties, and to provide a contact electrification type electrophotographic apparatus employing the photoreceptor and less apt to suffer dielectric breakdown. The electrophotographic photoreceptor comprises an electrically conductive support having thereon an undercoat layer and a photosensitive layer, in which the undercoat layer comprises an electron-transporting pigment and a reactive organometallic compound. This electrophotographic photoreceptor is suitable for use in an electrophotographic apparatus in which the photoreceptor is charged by applying a voltage to a charging member disposed so as to be in contact with the photoreceptor, in particular, an erase-less electrophotographic apparatus.

20 Claims, 4 Drawing Sheets

ELECTROPHOTOGRAPHIC APPARATUS WITH PHOTORECEPTOR HAVING UNDERCOAT LAYER, CONTAINING AN ELECTRONIC TRANSPORTING PIGMENT AND REACTIVE ORGANOMETALLIC COMPOUND

This is a Division of application Ser. No. 08/561,231 filed Nov.21,1995, now U.S. Pat. No. 5,658,702.

FIELD OF THE INVENTION

The present invention relates to an electrophotographic photoreceptor and an electrophotographic apparatus. More specifically, this invention relates to an electrophotographic photoreceptor having an undercoat layer between an electrically conductive support and a photosensitive layer, and to an electrophotographic apparatus employing the photoreceptor.

BACKGROUND OF THE INVENTION

An electrophotographic photoreceptor comprises a support having an electrically conductive surface and a photosensitive layer formed on the surface. In general, however, a non-photosensitive layer called an undercoat layer or interlayer is disposed between the photosensitive layer and the support for improving adhesion between the photosensitive layer and the support, improving coating applicability of photosensitive-layer formation, protecting the support surface, covering surface defects on the support, protecting the photosensitive layer against electrical breakdown, improving charge injection property into the photosensitive layer, etc. Known materials for use in forming this layer include polyurethanes, polyamides, poly(vinyl alcohol), epoxy ethylene-acrylic acid copolymers, ethylene-vinyl acetate copolymers, casein, methyl cellulose, nitrocellulose, phenolic resins, and organometallic compounds, as described, for example, in JP-A-48-47332 (the term "JP-A" as used herein means an "unexamined published Japanese patent application"), JP-A-51-114132, JP-A-52-42123, JP-A-59-23439, and JP-A-62-284362.)

However, these conventional undercoat layers have the following drawbacks. There are cases where according to the composition of the charge generating layer, the movement of charge carriers to flow into the support is inhibited, to thereby cause re-coupling thereof with countercharge carriers within the charge generating layer or accumulation thereof at the interface between the undercoat layer and the charge generating layer to form a barrier of space charges. Upon repeated use, such a photoreceptor undergoes a decrease in electrification potential, an increase in residual potential, etc. In addition, since charge transport in these conventional undercoat layers is attributable mainly to the water contained therein, the properties of the conventional photoreceptors considerably vary with changing humidity. To eliminate these drawbacks, it has been proposed to incorporate an electron-donor into an undercoat layer. For example, JP-B-61-35551 (the term "JP-B" as used herein means an "examined Japanese patent publication") discloses the formation of a barrier layer containing a non-hydrophilic peptide polymer and either an electron-donor or an electron-acceptor, while JP-A-60-218655 discloses the formation of an undercoat layer containing an electron-donor. In JP-A-61-80158 is disclosed the formation of an undercoat layer containing a hydrazone compound. Further, JP-A-61-204640 discloses the formation of an undercoat layer containing a charge transporting material such as imidazole, pyrazoline, thiazole, oxadiazole, oxazole, a hydrazone, a ketazine, an azine, carbazole, polyvinylcarbazole, etc.

In contrast to the above-described technique, a technique for overcoming the above-described drawbacks by incorporating an electron-acceptor into an interlayer to facilitate electron transfer therethrough is disclosed in, e.g., JP-B-61-35551 and JP-A-59-160147. Furthermore, JP-A-58-209751 discloses the formation of a precoat layer containing a n-type dye or pigment, and JP-A-63-210848 discloses the formation of an undercoat layer containing an electron-transferring pigment.

However, photoreceptors having an undercoat layer containing an electron-donor as described above have a problem that the undercoat layer cannot fully perform its function because the electrons generated in the photosensitive layer tend to be trapped and re-couple with positive holes to cause a sensitivity decrease.

On the other hand, in photoreceptors having an undercoat layer containing an electron-acceptor, the undercoat layer sufficiently performs its function. However, since the electron-acceptors disclosed in JP-B-61-35551 and JP-A-59-160147 are soluble in solvents, such photoreceptors have a drawback that during the formation of a photosensitive layer on the undercoat layer by coating, especially by dip coating, the electron-acceptors partly dissolve away and come into the photosensitive layer or the coating solution. In this respect, the pigments disclosed in JP-A-58-209751 and JP-A-63-210848 are slightly soluble or insoluble in solvents and hence do not dissolve into photosensitive layers. However, since the undercoat layer containing this kind of pigment is formed by applying a dispersion of the pigment in a resin which is solvent-soluble, photoreceptors having this undercoat layer have a drawback that during the formation of a photosensitive layer on the undercoat layer by coating, the resin partly dissolves away to cause coating film defects, making the undercoat layer incapable of sufficiently performing its function. The present invention has been achieved under the circumstances described above.

SUMMARY OF THE INVENTION

Therefore, an object of the present invention is to provide an electrophotographic photoreceptor which has an undercoat layer slightly soluble or insoluble in solvents and retains stable properties.

Another object of the present invention is to provide an electrophotographic apparatus employing the electrophotographic photoreceptor described above.

Other objects and effects of the present invention will be apparent from the following description.

The present inventors conducted investigations on various materials to examine the influence of undercoat layers on electrophotographic properties. As a result, they have found that when an electron-transporting pigment and a reactive organometallic compound are incorporated in an undercoat layer or when this undercoat layer further contains a binder resin, the reactive organometallic compound chemically reacts with the electron-transporting pigment or with both the pigment and the binder resin to bring about excellent electrophotographic properties. It has also been found that this specific undercoat layer can have a large thickness without impairing electrophotographic properties and hence can impart high voltage resistance to the photoreceptor, that is, the photoreceptor is less apt to undergo dielectric breakdown even when used in contact electrification. It has been further found that the electrophotographic photoreceptor employing this specific undercoat layer has an exceedingly low residual potential and, even when used in an erase-less electrophotographic apparatus, it does not cause a residual image (ghost) and shows excellent electrophotographic properties.

The above objects of the present invention is achieved by providing:

(A) a negative-electrification type electrophotographic photoreceptor comprising an electrically conductive support having thereon an undercoat layer and a photosensitive layer, wherein the undercoat layer comprises an electron-transporting pigment and a reactive organometallic compound;

(B) an electrophotographic apparatus having:

a negative-electrification type electrophotographic photoreceptor comprising an electrically conductive support having thereon an undercoat layer and a photosensitive layer; and a charging member disposed so as to be in contact with the photoreceptor, to the charging member a voltage being applied, wherein the undercoat layer of the photoreceptor comprises an electron-transporting pigment and a reactive organometallic compound; and (C) an erase-less electrophotographic apparatus having:

a negative-electrification type electrophotographic photoreceptor comprising an electrically conductive support having thereon an undercoat layer and a photosensitive layer; and a charging member disposed so as to be in contact with the photoreceptor, to the charging member a voltage being applied, for forming an image according to a process comprising charging, exposure, development and transfer in one electrophotographic cycle, followed by charging of the next cycle without erasing any residual charges, wherein the undercoat layer of the photoreceptor comprises an electron-transporting pigment and a reactive organometallic compound.

DETAILED DESCRIPTION OF THE INVENTION

The detailed description of the present invention is described referring to the accompanied drawing.

First, the electrophotographic photoreceptor of the present invention is described in detail below.

Figure 1:
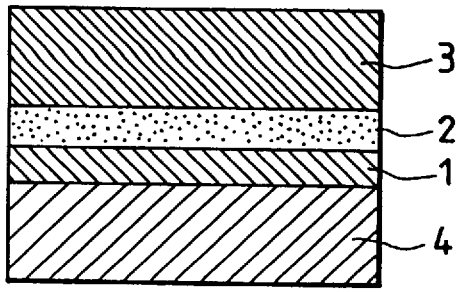
FIG. 1 is a diagrammatic sectional view of one embodiment of the electrophotographic photoreceptor according to the present invention.
Figure 2:
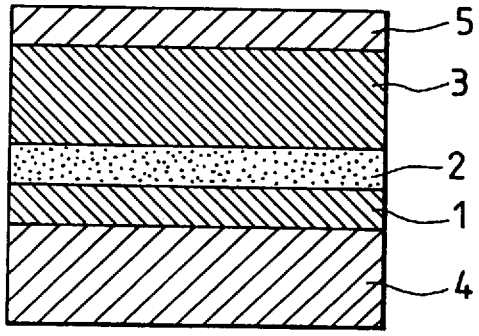
FIG. 2 is a diagrammatic sectional view of another embodiment of the electrophotographic photoreceptor according to the present invention.
Figure 3:
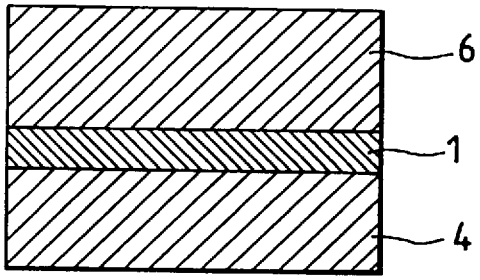
FIG. 3 is a diagrammatic sectional view of still another embodiment of the electrophotographic photoreceptor according to the present invention.
Figure 4:
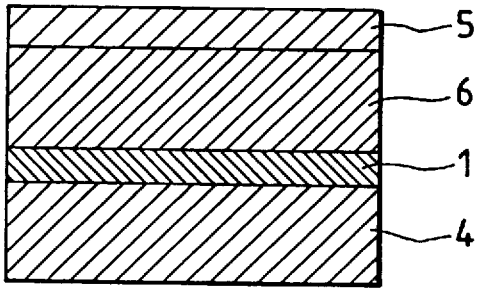
FIG. 4 is a diagrammatic sectional view of a further embodiment of the electrophotographic photoreceptor according to the present invention.

FIGS. 1 to 4 each is a diagrammatic sectional view of an electrophotographic photoreceptor according to the present invention. FIGS. 1 and 2 each illustrates a photoreceptor which has a photosensitive layer having a multilayer structure, while FIGS. 3 and 4 each illustrates a photoreceptor which has a photosensitive layer having a single-layer structure. The photoreceptor shown in FIG. 1 comprises an electrically conductive support 4 having thereon an undercoat layer 1, a charge generating layer 2 and a charge transporting layer 3 in this order. The photoreceptor shown in FIG. 2 further comprises a protective layer 5 as the uppermost layer. The photoreceptor shown in FIG. 3 comprises an electrically conductive support 4 having thereon an undercoat layer 1, a photosensitive layer 6 in this order. The photoreceptor shown in FIG. 4 further comprises a protective layer 5 as the uppermost layer.

Examples of the electrically conductive support 4 include metals such as aluminum, nickel, chromium, and stainless steel, plastic or other films having deposited thereon a thin film of, e.g., aluminum, titanium, nickel, chromium, stainless steel, gold, vanadium, tin oxide, indium oxide, or ITO, and paper sheets and plastic or other films coated or impregnated with a conductivity-imparting agent. These electrically conductive supports may be used in a suitable form such as a drum, sheet or plate form, but the support form is not limited thereto. The surface of the electrically conductive support 4 may be subjected to various treatments as needed, as long as such treatments do not adversely influence image quality. For example, the support surface may be subjected to an oxidation treatment, a chemical treatment, a coloring treatment, or a treatment for irregular reflection, e.g., honing.

The undercoat layer 1 is formed on the electrically conductive support 4. This undercoat layer 1 mainly performs the following functions: (1) to inhibit unnecessary carrier injection from the support 4 to improve image quality; (2) to enable the photoreceptor to exhibit a stable photodecay curve with diminished fluctuations with environmental changes to give stable image quality; (3) to have a moderate charge-transporting ability to prevent accumulation of charges even in repeated use and to thereby keep the sensitivity constant; (4) to have moderate resistance to electrification voltage to thereby prevent occurrence of image defects caused by dielectric breakdown; and (5) to serve as an adhesive layer to bond and unite the photosensitive layer 6 to the support 4. In some cases, the undercoat layer 1 also functions (6) to prevent the reflection of light from the support 4.

Examples of the electron-transporting pigment for use in the undercoat layer 1 in the present invention include the organic pigments described in JP-A-47-30330, e.g., perylene pigments, bisbenzimidazoleperylene pigments, polycyclic quinone pigments, indigo pigments, and quinacridone pigments; other organic pigments such as azo and phthalocyanine pigments having an electron-attracting substituent, e.g., a cyano group, nitro group, nitroso group or halogen atom; and inorganic pigments such as zinc oxide and titanium oxide. Preferred of these pigments are perylene pigments, bisbenzimidazoleperylene pigments, and polycyclic quinone pigments, in particular brominated anthanthrone pigments, because they have a high electron-transporting ability. The structural formulae of specific electron-transporting pigments are given below.
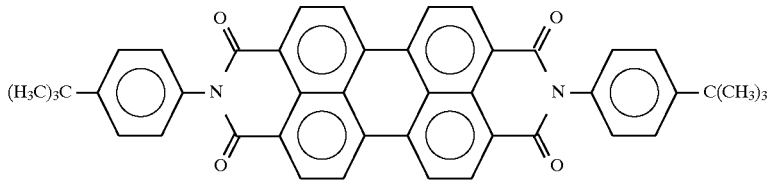
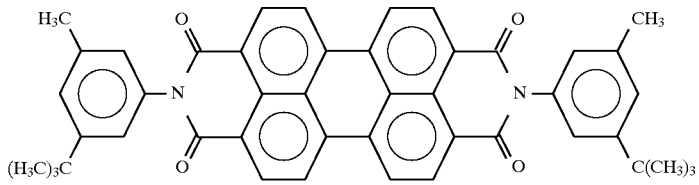
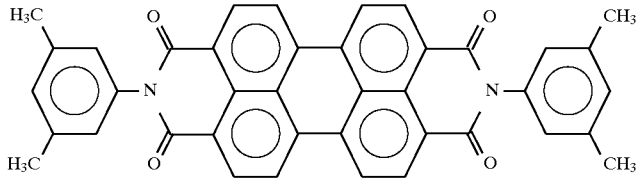
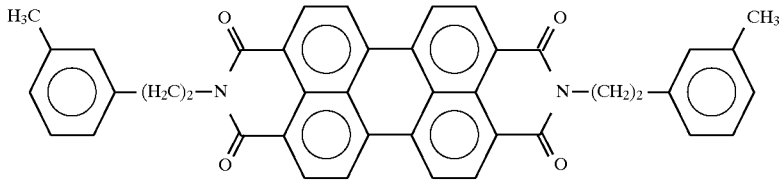
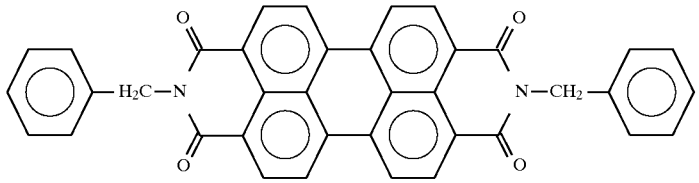
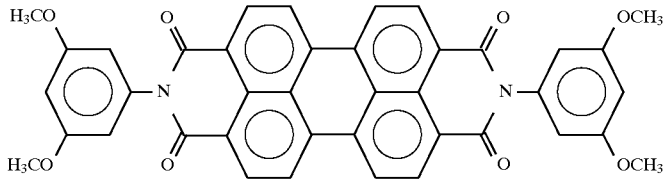
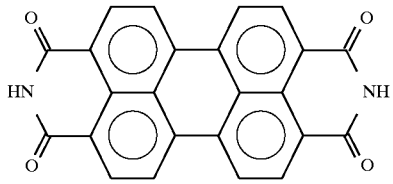
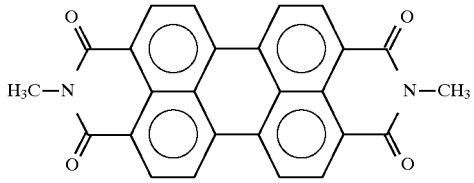

-continued
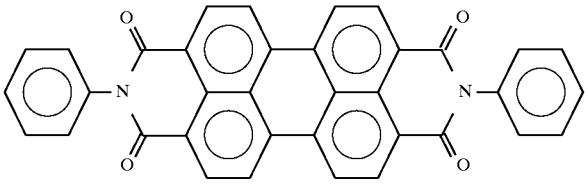
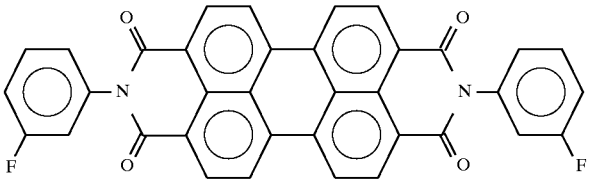
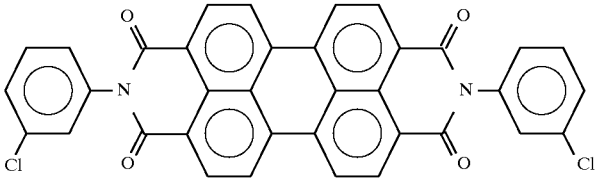
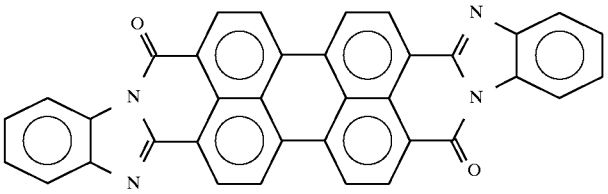
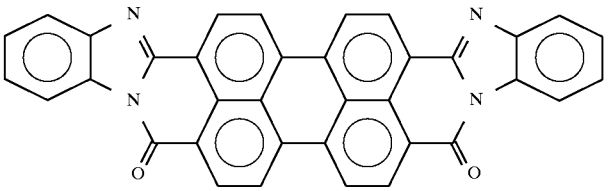
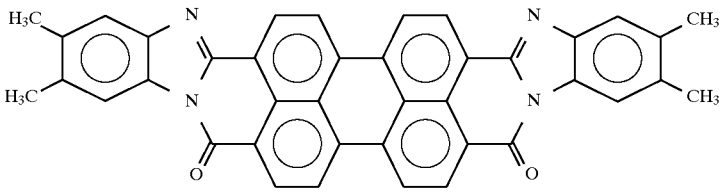
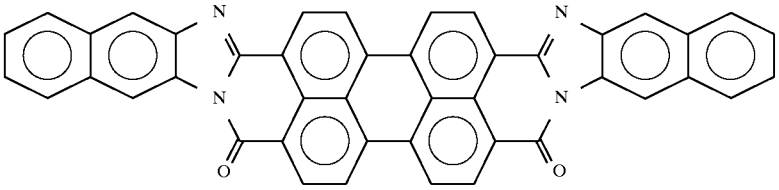
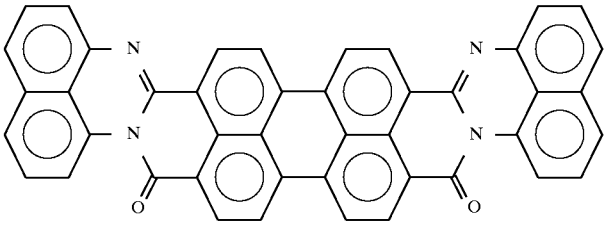

-continued
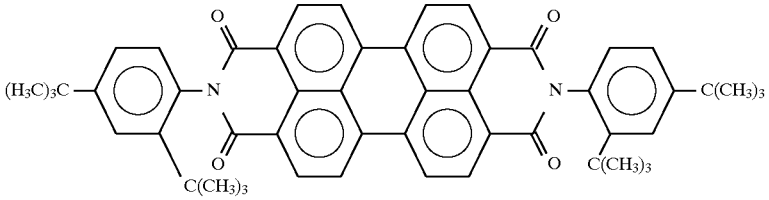
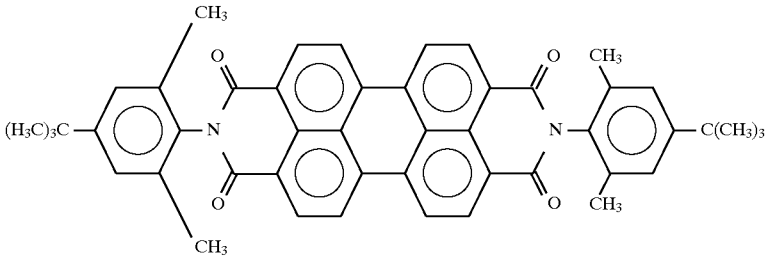
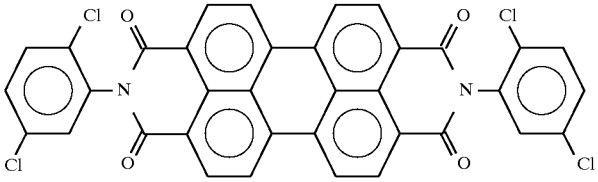
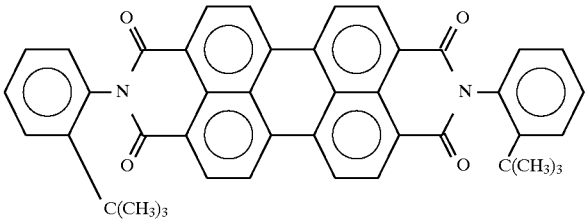
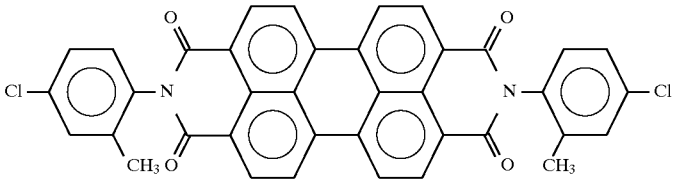
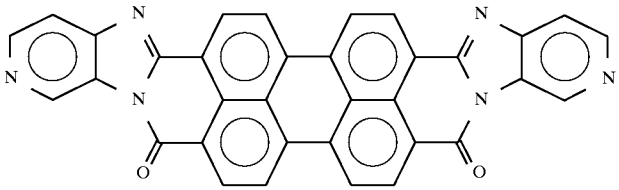
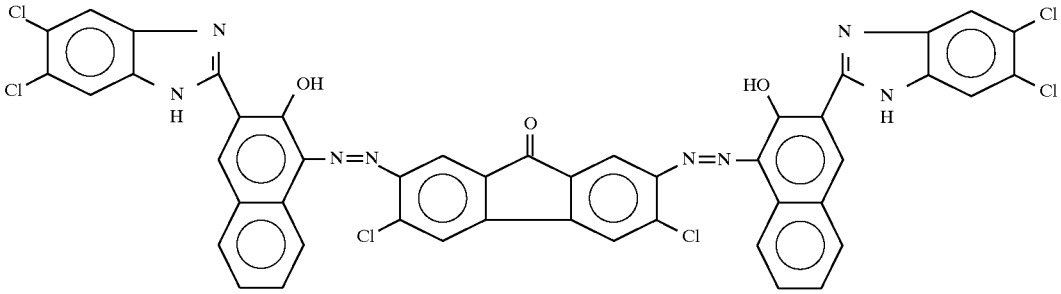

-continued
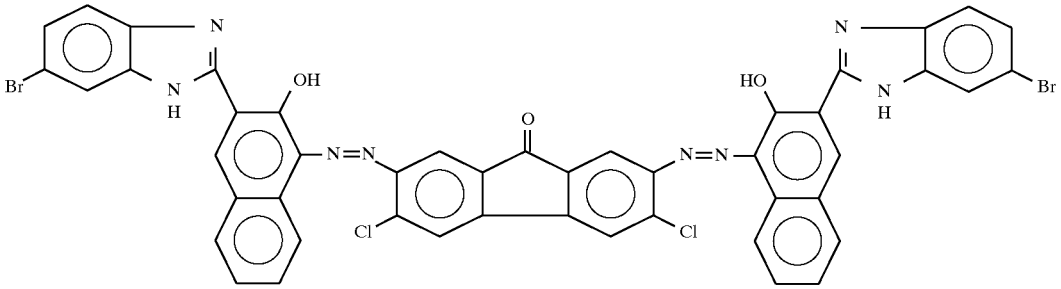
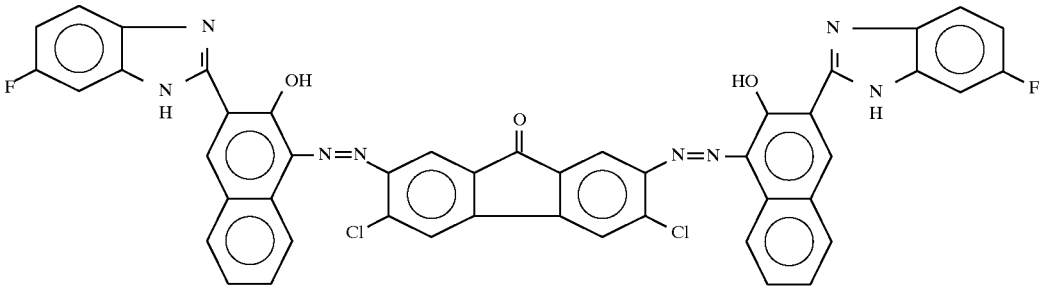
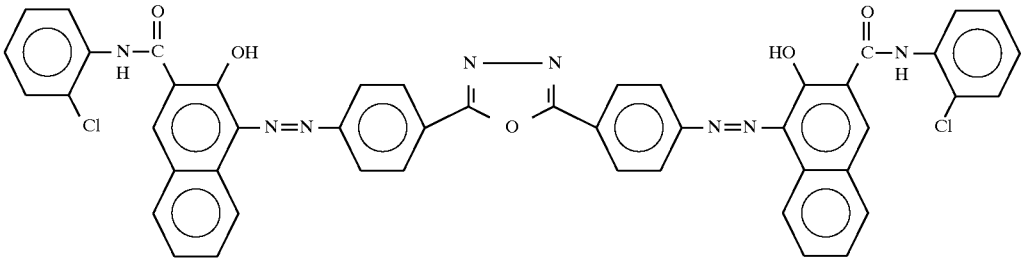
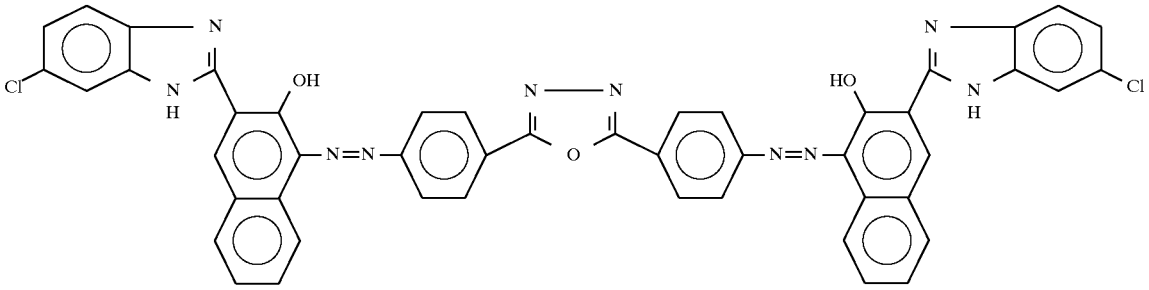
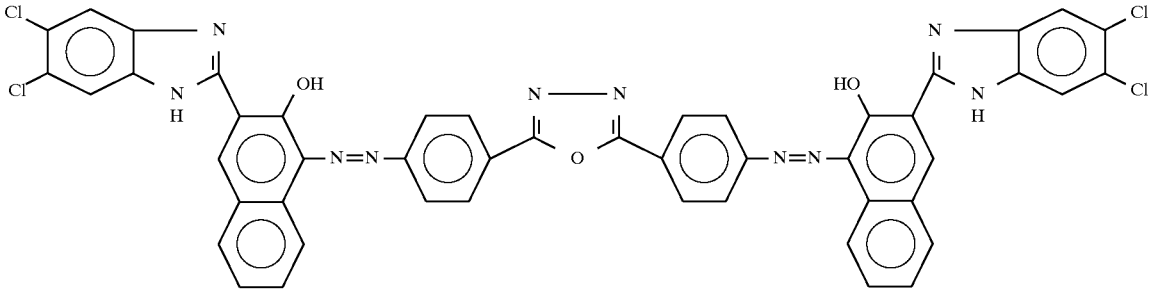

-continued
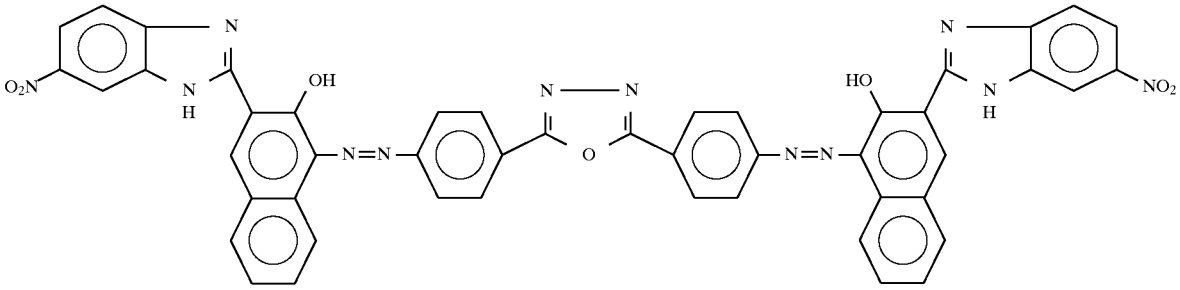
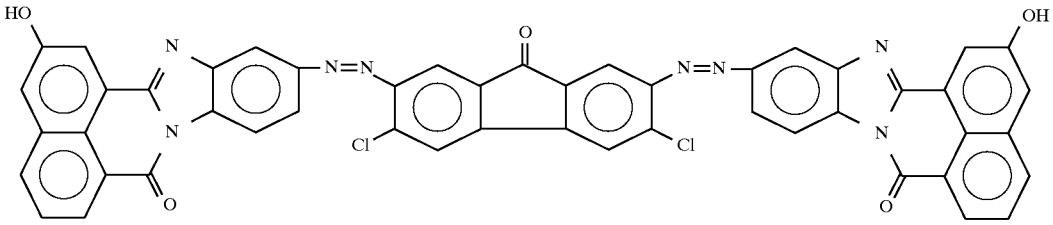
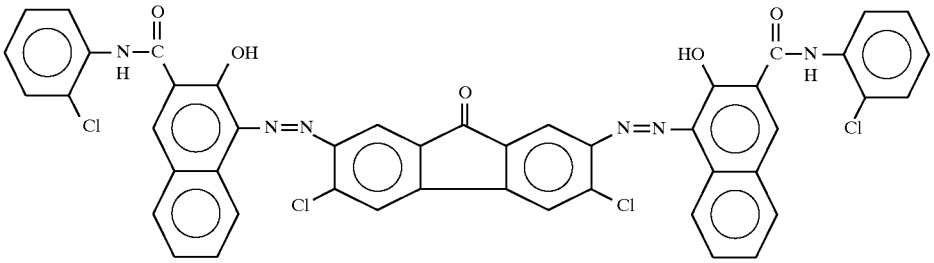
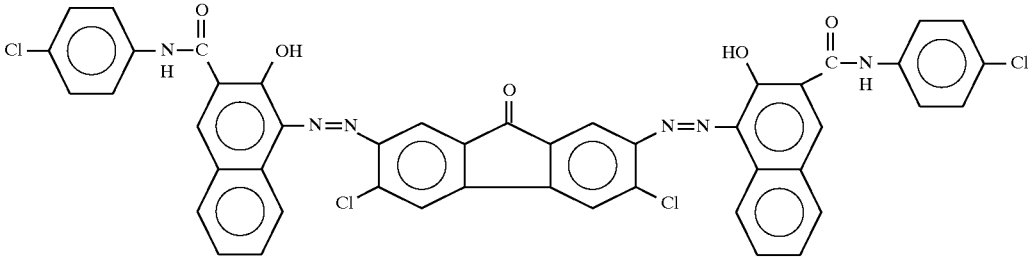
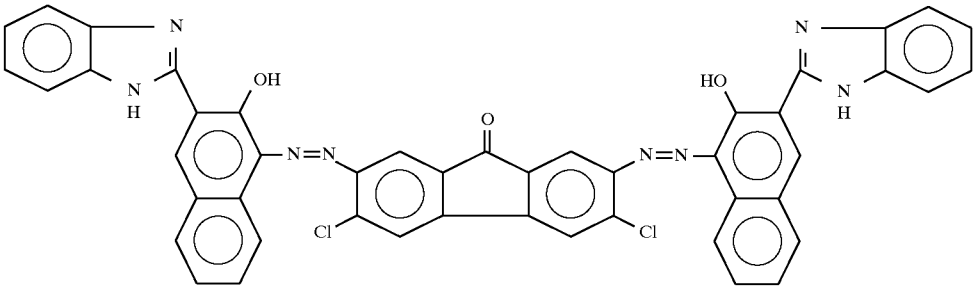
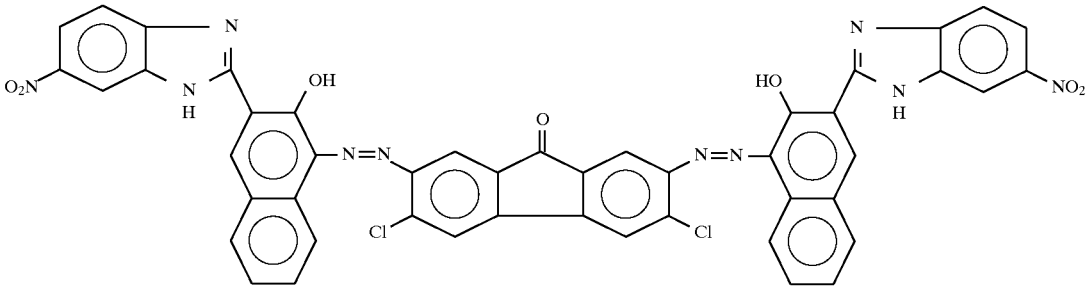

-continued
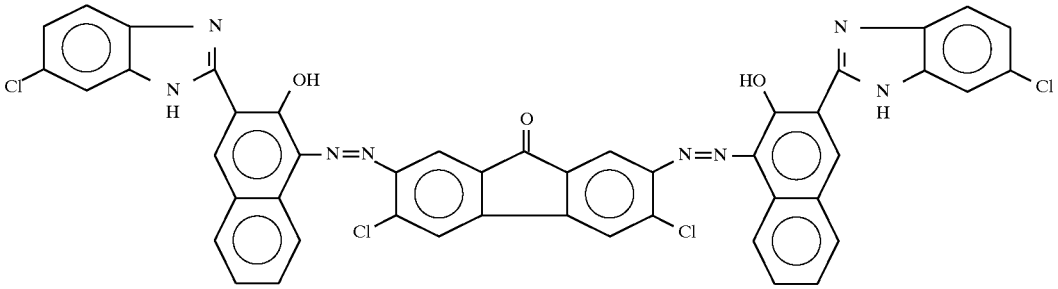
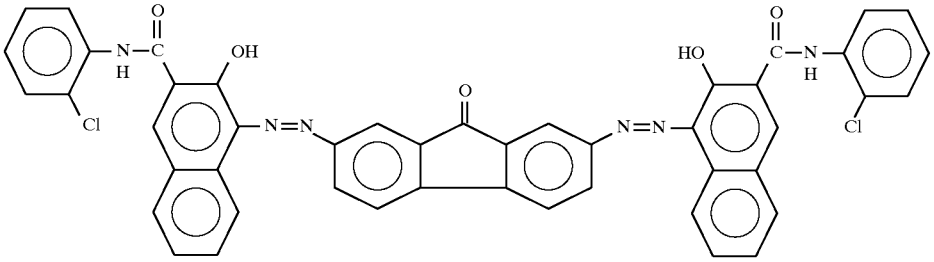
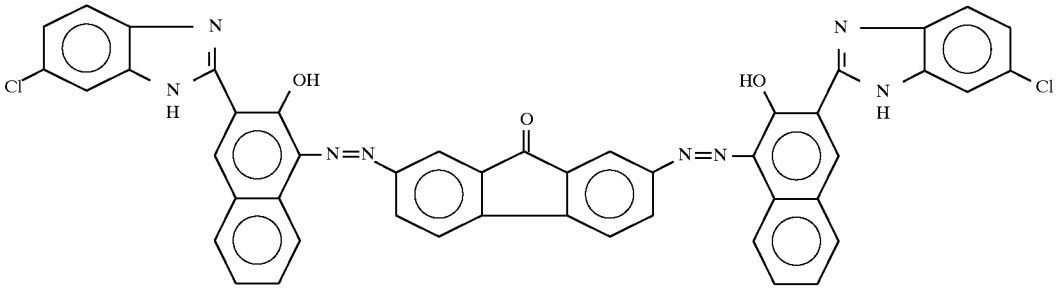
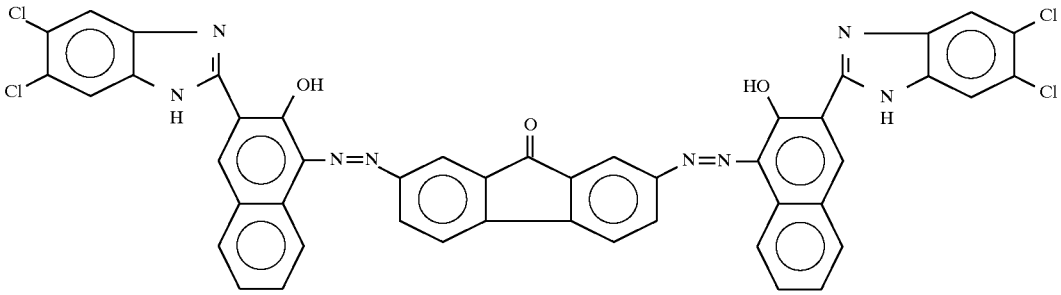
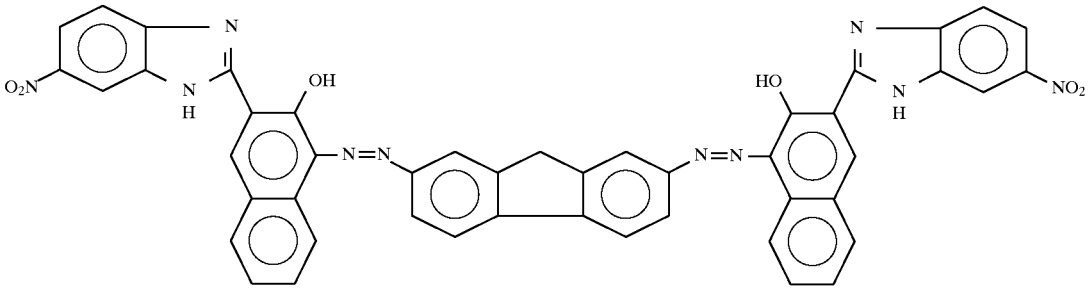

-continued
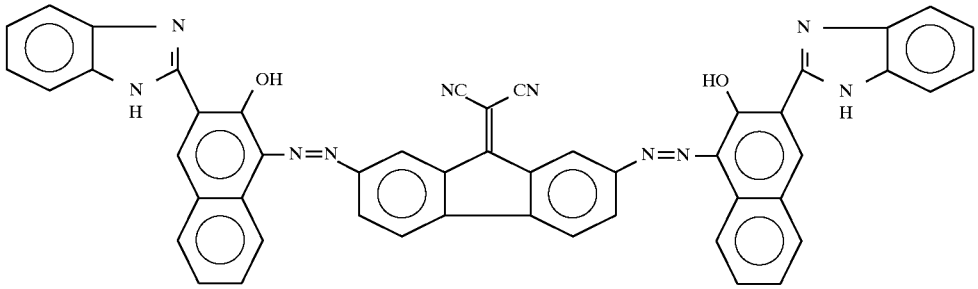
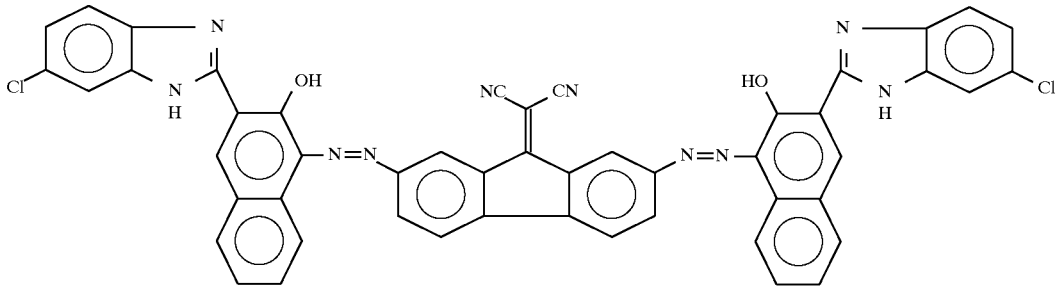
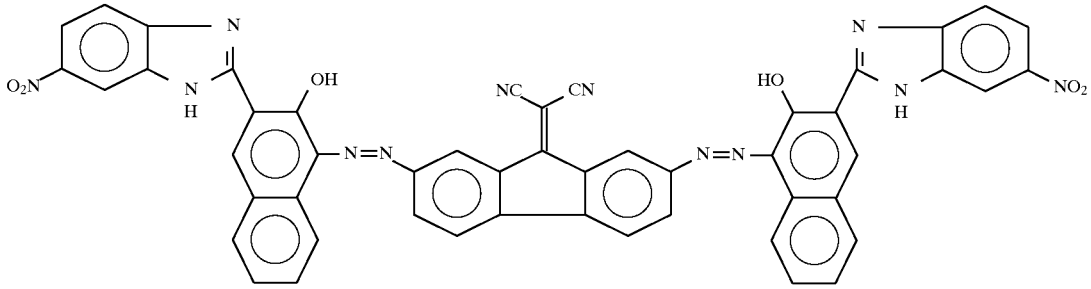
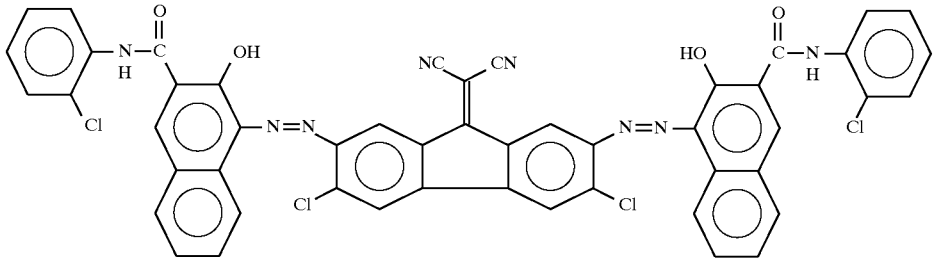
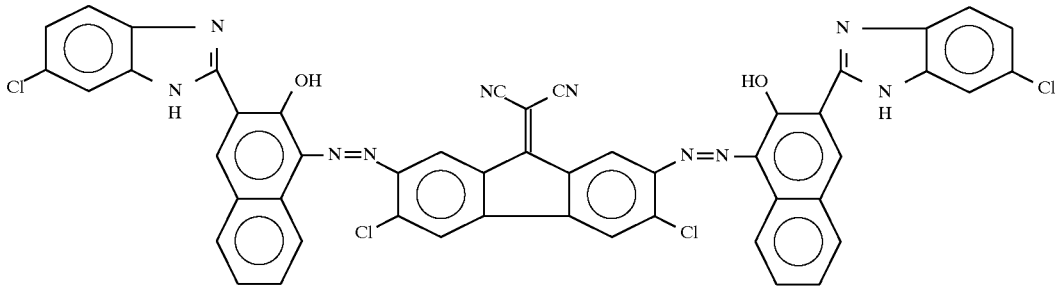

-continued
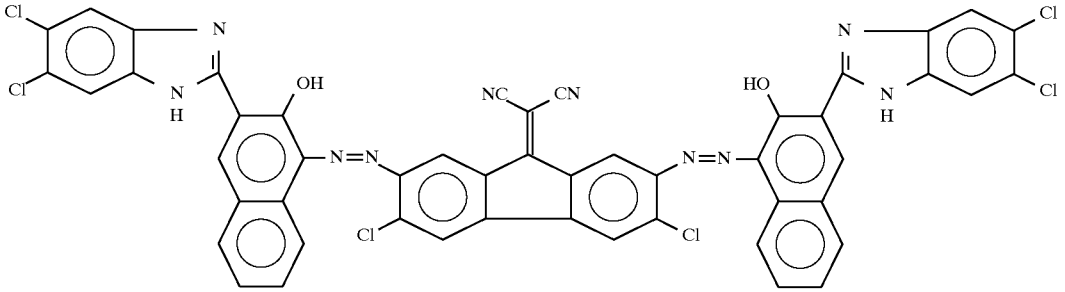
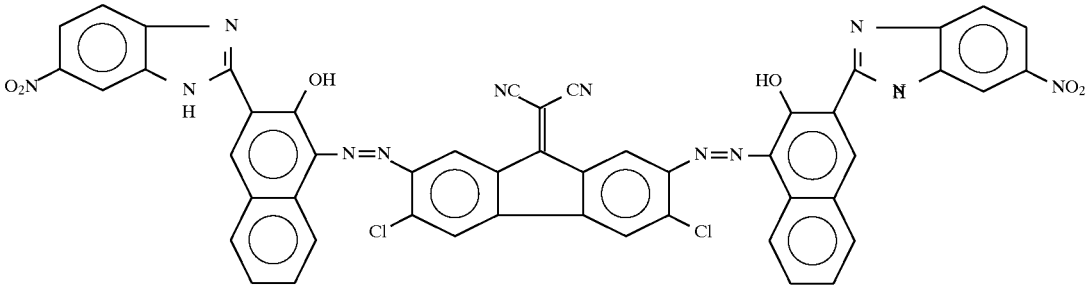
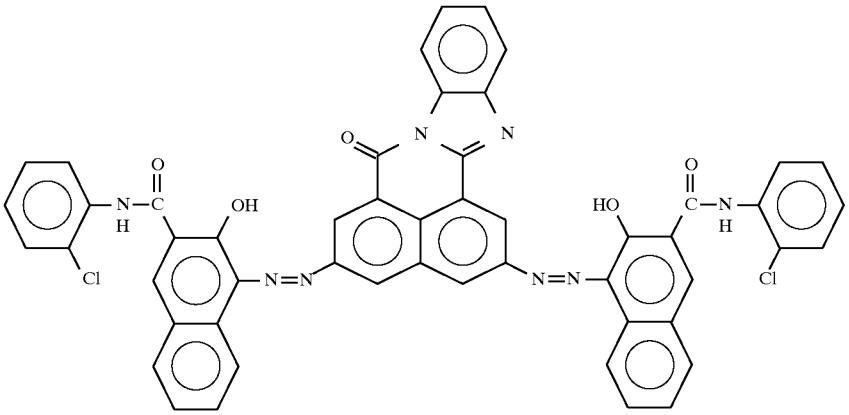
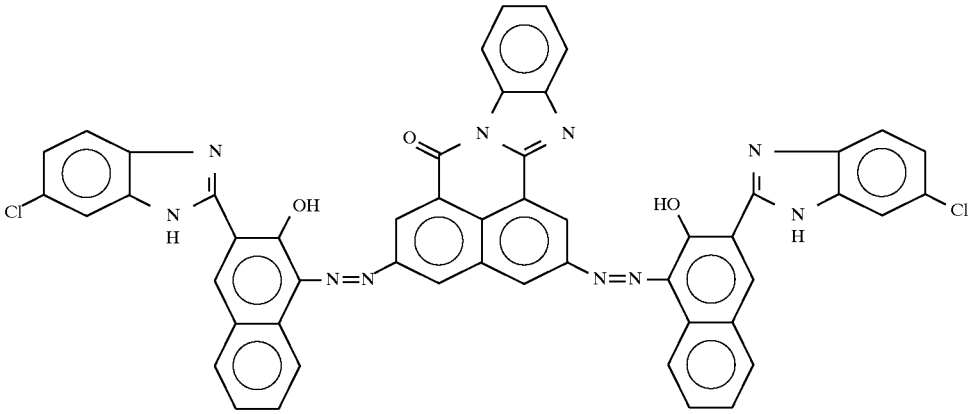

-continued
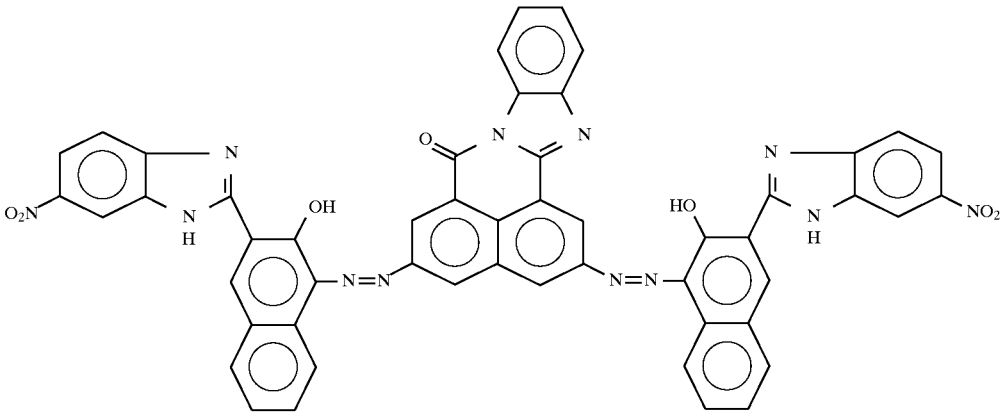
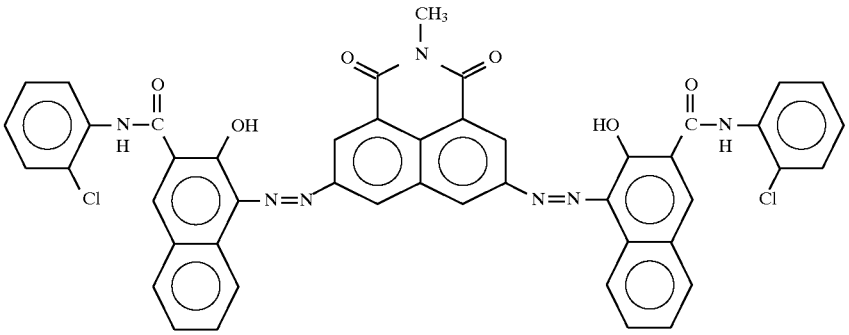
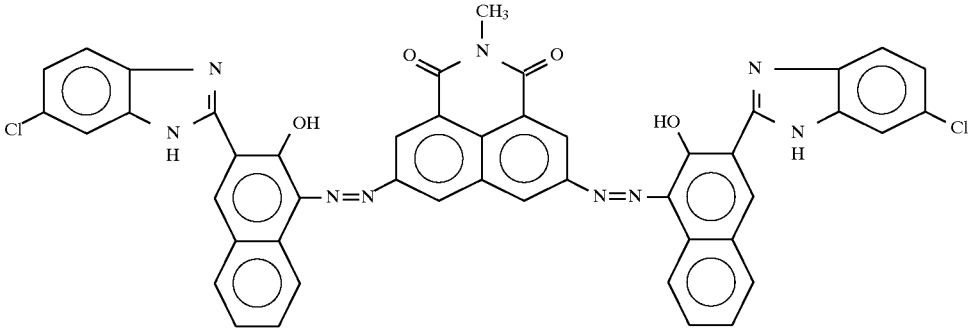
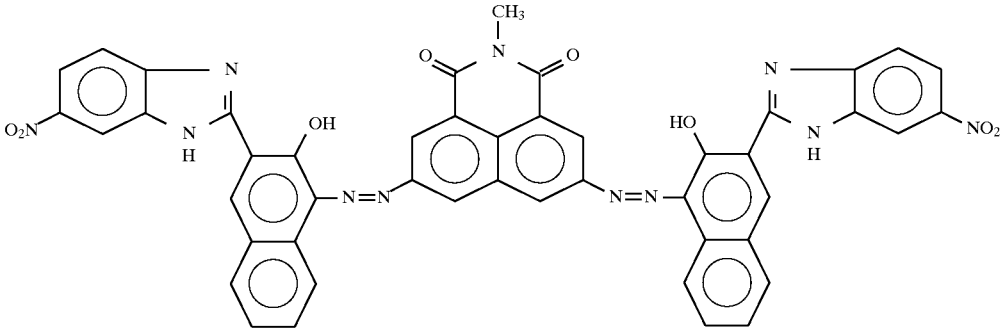

-continued

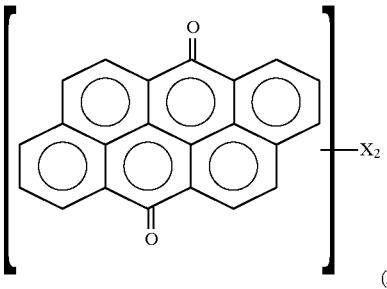

(X = Cl, Br, F)

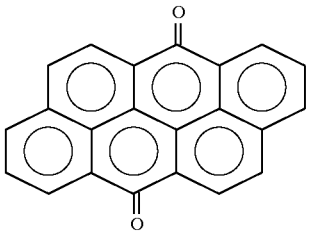

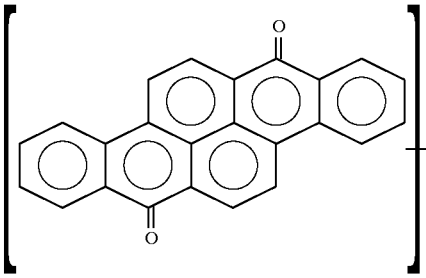

(X = Cl, Br, F)

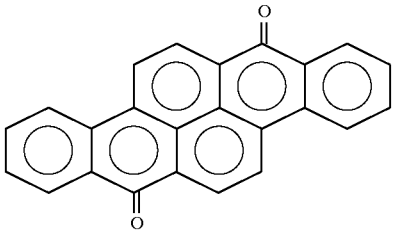

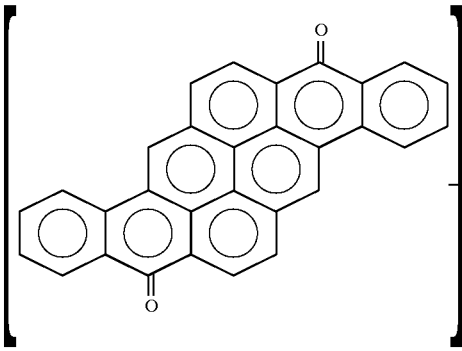

(X = Cl, Br, F)

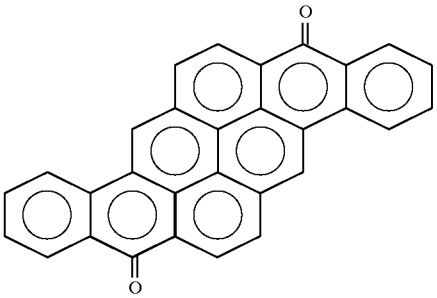

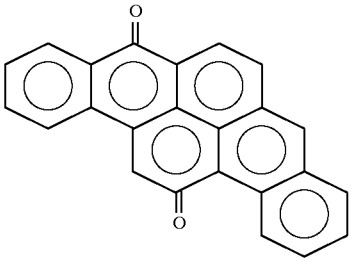

The electron-transporting ability of the pigment for use in the undercoat layer 1 in the present invention can be measured by delayed collection field method. A thin injection-inhibiting layer is formed on a nasa-glass and a dispersion of the pigment in a resin is applied thereon at a thickness of several micrometers, following which a gold electrode is formed thereon by vapor deposition to give a sample having the structure of a capacitor. For example, a negative voltage is applied to the nasa-glass side and a positive voltage is applied to the gold electrode, or a voltage is applied inversely. While the sample is kept in this state, a laser pulse is applied from the nasa-glass side to generate positive or negative carriers on the surface of the pigment dispersion film. The mobility of the resulting electrons and positive holes through the pigment dispersion film is measured. Pigments which, in this test, have the property of transferring at least electrons are preferably used as the electron-transporting pigment.

The reactive organometallic compound for use in this invention means an organometallic compound which undergoes a hydrolysis reaction with water.

Examples of the reaction of the organometallic compound with a pigment include hydrolysis reaction with water adsorbed to the surface of pigment aggregates; hydrolysis reaction with water contained in pigment aggregate; and in the case of a hydroxylated pigment, hydrolysis reaction with hydroxyl groups exposed on the surface of pigment aggregates.

With respect to reaction with a resin, the organometallic compound undergoes hydrolysis reaction with hydroxyl groups contained in the resin.

Examples of the reactive organometallic compound for use in the undercoat layer 1 in the present invention include organozirconium compounds such as zirconium chelate compounds, zirconium alkoxide compounds and zirconium coupling agents; organotitanium compounds such as titanium chelate compounds, titanium alkoxide compounds and titanate coupling agents; organoaluminum compounds such as aluminum chelate compounds and aluminum coupling agents; and other organometallic compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds and aluminum zirconium alkoxide compounds. However, the reactive organometallic compound for use in this invention should not be construed as being limited to these examples. Preferred of these organometallic compounds are organozirconium compounds, organotitanyl compounds and organoaluminum compounds, in particular, zirconium alkoxide compounds, zirconium chelate compounds, titanium alkoxide compounds and titanium chelate compounds, because they bring about a low residual potential and satisfactory electrophotographic properties.

The undercoat layer 1 for use in the present invention may be formed from a composition obtained by mixing the electron-transporting pigment and the reactive organometallic compound with a binder resin to disperse the pigment and the compound into the resin. A known resin conventionally used as a binder in undercoat layers may be used as the binder resin for use in the present invention. Examples thereof include poly(vinyl acetal), poly(vinyl alcohol), poly (vinyl methyl ether), poly(N-vinylimidazole), poly(ethylene oxide), ethyl cellulose, methyl cellulose, ethylene-acrylic acid copolymers, polyamides, polyimides, casein, gelatin, polyethylene, polyesters, polypropylene, acrylic resins, methacrylic resins, vinyl chloride resins, vinyl acetate resins, vinylidene chloride resins, water-soluble polyester resins, polycarbonate resins, phenolic resins, vinyl chloride-vinyl acetate copolymers, epoxy resins, polyvinylpyrrolidone, polyvinylpyridine, polyurethanes, poly(glutamic acid) and poly(acrylic acid). Especially preferred of these are those having hydroxyl groups which readily undergo a reaction, e.g., crosslinking, with the organometallic compound. The binder resin for use in the present invention should not be construed as being limited to these examples. These binder resins may be used either alone or as a mixture of two or more thereof.

In the present invention, the reactive organometallic compound incorporated in the coating film containing the electron-transporting pigment dispersed in the binder resin serves to make the coating film insoluble in a coating solution used for forming an upper layer.

Furthermore, in the case where the coating film containing the electron-transporting pigment dispersed in the resin is used as the undercoat layer 1, the electron-transporting pigment functions to transport electrons, while the resin functions to block positive holes. Although sufficient blocking performance can be maintained by incorporating the resin in a larger proportion, the increased resin proportion results in a significantly impaired environmental stability. Due to the incorporation of the organometallic compound, sufficient blocking performance can be maintained without increasing the resin amount.

For the mixing/dispersion for preparing a coating solution for the undercoat layer 1, the following techniques may, for example, be used: a method comprising dispersing the electron-transporting pigment into a solution of the organometallic compound; a method comprising mixing the organometallic compound with a dispersion of the electron-transporting pigment; a method comprising mixing the organometallic compound with a dispersion of the electron-transporting pigment in the binder resin; a method comprising mixing the organometallic compound with a solution of the binder resin and then dispersing the electron-transporting pigment into the mixture; and a method comprising mixing the organometallic compound with the electron-transporting pigment and then dispersing the mixture into a solution of the binder resin. It is important that this mixing/dispersion for preparing a coating solution should be conducted so as not to cause gelation, aggregation, etc. Most of the gelation reactions due to the addition reaction of the reactive organometallic compound are gelation reactions of the binder resin caused by the organometallic compound. To avoid gelation during mixing, it is preferred to use a method in which the pigment is sufficiently dispersed into the binder resin, desirably at a low resin concentration, and then the organometallic compound is added to the dispersion and mixed.

The proportion of the electron-transporting pigment to the organometallic compound is generally regulated to the range of from 1:0.01 to 1:1 by weight. In the case where the binder resin is contained, the proportion of the electron-transporting pigment to the binder resin is generally regulated to the range of from 0.1:1 to 9:1 by weight. Too small proportions of the electron-transporting pigment result in an insufficient electron-transporting effect, while too large proportions thereof may result in a coating solution having a reduced life or undergoing aggregation to raise coating difficulties. If the proportion of the organometallic compound is too small, the coating solution applied for forming the undercoat layer 1 exhibits poor film-forming properties, and this may pose a problem concerning coating applicability for forming an upper layer or a problem that the undercoat layer 1 dissolves during coating for upper-layer formation. Too large proportions of the organometallic compound result in a coating solution which may have a reduced life or undergo aggregation to raise coating difficulties. An ordinary dispersing means may be used for the mixing/dispersion such as those using a ball mill, roll mill, sand mill, attritor or ultrasonic. The mixing/dispersion is conducted in an organic solvent. Any organic solvent may be used as long as the organometallic compound and the binder resin dissolve therein and the solvent does not cause gelation or aggregation upon the mixing/dispersion of the electron-transporting pigment. Examples of the solvent include ordinarily used organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used either alone or as a mixture of two or more thereof.

A silane coupling agent may be incorporated in the undercoat layer 1 in the present invention. Any known silane coupling agent may be used. Examples thereof include vinyltrichlorosilane, vinyltrimethoxysilane, vinyltriethoxysilane, vinyltris(2-methoxyethoxy)silane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane and β-3,4-epoxycyclohexyltrimethoxysilane. The amount of the silane coupling agent contained in the undercoat layer 1 is preferably from 0.1 to 10% by weight based on the weight of the electron-transporting pigment, from the standpoint of adhesion.

The thickness of the undercoat layer 1 in the present invention is regulated to generally from 0.1 to 20 μm, preferably from 0.5 to 10 μm. For forming the undercoat layer 1, an ordinary coating technique may be employed such as blade coating, wire-wound bar coating, spray coating, dip coating, bead coating, air-knife coating or curtain coating. The resulting coating is dried usually at a temperature necessary to solvent evaporation and film formation. Thus, the undercoat layer 1 is obtained.

The photosensitive layer 6 formed on the undercoat layer 1 is described below. The photosensitive layer 6 for use in the present invention may have a multilayer structure comprising the charge generating layer 2 and the charge transporting layer 3 so as to allot functions of the photosensitive layer 6 to these layers. In the multilayered photosensitive layer, the charge generating layer 2 comprises a known charge generating material and a binder resin.

Although any known charge generating material may be used, metal and metal-free phthalocyanine pigments are preferred. Especially preferred of these are hydroxygallium phthalocyanine, chlorogallium phthalocyanine, dichlorotin phthalocyanine and titanyl phthalocyanine which each has a specific crystal form. The chlorogallium phthalocyanine having a novel crystal form for use in the present invention can be produced by the method disclosed in JP-A-5-98181, that is, by subjecting chlorogallium phthalocyanine crystals produced by a known process to mechanical dry grinding with, e.g., an automatic mortar, planetary mill, oscillating mill, CF mill, roller mill, sand mill or kneader, or by subjecting the dry-ground chlorogallium phthalocyanine crystals to a wet grinding treatment together with a solvent by means of, e.g., a ball mill, mortar, sand mill or kneader. Examples of the solvent used in the above treatment include aromatics (e.g., toluene and chlorobenzene), amides (e.g., dimethylformamide and N-methylpyrrolidone), aliphatic alcohols (e.g., methanol, ethanol and butanol), aliphatic polyhydric alcohols (e.g., ethylene glycol, glycerol and polyethylene glycol), aromatic alcohols (e.g., benzyl alcohol and phenethyl alcohol), esters (e.g., acetic esters including butyl acetate), ketones (e.g., acetone and methyl ethyl ketone), dimethyl sulfoxide, ethers (e.g., diethyl ether and tetrahydrofuran), mixtures of two or more of such organic solvents, and mixtures of water and one or more of such organic solvents. The solvent is used in an amount of generally from 1 to 200 parts by weight, preferably from 10 to 100 parts by weight, per 100 parts by weight of the chlorogallium phthalocyanine. The treatment is carried out at a temperature of generally from 0° C. to the boiling point of the solvent, preferably from 10° to 60° C. A grinding aid, e.g., common salt or Glauber's salt, may be used in the grinding in an amount of generally from 0.5 to 20 times, preferably from 1 to 10 times, the amount of the charge generating layer 2.

The dichlorotin phthalocyanine having a novel crystal form can be obtained by the method disclosed in JP-A-5-140472 and JP-A-5-140473, that is, by subjecting dichlorotin phthalocyanine crystals produced by a known process to a treatment with a solution or to a dry grinding or a wet grinding treatment in the same manner as for the above-described chlorogallium phthalocyanine.

The hydroxygallium phthalocyanine having a novel crystal form can be obtained by the method disclosed in JP-A-5-263007 and JP-A-5-279591. That is, chlorogallium phthalocyanine crystals produced by a known process is first subjected to hydrolysis in an acid or alkaline solution or to acid pasting to synthesize hydroxygallium phthalocyanine crystals. The synthesized crystals are subjected directly to a treatment with a solvent or to a wet grinding treatment together with a solvent by means of a ball mill, mortar, sand mill, kneader or the like. Alternatively, the synthesized hydroxygallium phthalocyanine crystals are subjected to dry grinding without using a solvent, followed by a treatment with a solvent. Thus, the desired hydroxygallium phthalocyanine can be produced. Examples of the solvent used in the above treatments include aromatics (e.g., toluene and chlorobenzene), amides (e.g., dimethylformamide and N-methylpyrrolidone), aliphatic alcohols (e.g., methanol, ethanol and butanol), aliphatic polyhydric alcohols (e.g., ethylene glycol, glycerol and polyethylene glycol), aromatic alcohols (e.g., benzyl alcohol and phenethyl alcohol), esters (e.g., acetic esters including butyl acetate), ketones (e.g., acetone and methyl ethyl ketone), dimethyl sulfoxide, ethers (e.g., diethyl ether and tetrahydrofuran), mixtures of two or more of such organic solvents, and mixtures of water and one more of such organic solvents. The solvent is used in an amount of generally from 1 to 200 parts by weight, preferably from 10 to 100 parts by weight, per 100 parts by weight of the hydroxygallium phthalocyanine. The treatments are carried out at a temperature of generally from 0° to 150° C., preferably from room temperature to 100° C. A grinding aid, e.g., common salt or Glauber's salt, may be used in the grinding in an amount of generally from 0.5 to 20 times, preferably from 1 to 10 times, the amount of the charge generating material.

The oxytitanyl phthalocyanine having a novel crystal form can be obtained by the disclosed in JP-A-4-189873 and JP-A-5-43813. That is, oxytitanyl phthalocyanine crystals produced by a known process is first subjected to acid pasting or salt milling together with an inorganic salt by means of a ball mill, mortar, sand mill, kneader or the like to obtain oxytitanyl phthalocyanine crystals having a relatively low crystallinity and giving an X-ray diffraction spectrum having a peak at 27.2°. These crystals are then subjected directly to a treatment with a solvent or to a wet grinding treatment together with a solvent by means of a ball mill, mortar, sand mill, kneader or the like to produce the desired phthalocyanine. Sulfuric acid having a concentration of generally from 70 to 100%, preferably from 95 to 100%, is preferably used as the acid for the acid pasting, in which the phthalocyanine crystals are dissolved at a temperature of generally from −20° to 100° C., preferably from 0° to 60° C. The amount of the concentrated sulfuric acid is regulated to generally from 1 to 100 times, preferably from 3 to 50 times, the weight of the oxytitanyl phthalocyanine crystals. Water or a mixed solvent comprising water and an organic solvent is used for precipitation in any desired amount. Preferred precipitation solvents are mixed solvents comprising water and an alcohol solvent, e.g., methanol or ethanol, or comprising water and an aromatic solvent, e.g., benzene or toluene. Although the temperature for the precipitation is not particularly limited, it is preferred to prevent heat generation by cooling with, e.g., ice. The proportion of the oxytitanyl phthalocyanine crystals to the inorganic salt is from 1/0.1 to 1/20, preferably from 1/0.5 to 1/5, by weight. Examples of the solvent used in the solvent treatments include aromatics (e.g., toluene and chlorobenzene), aliphatic alcohols (e.g., methanol, ethanol and butanol), halogenated hydrocarbons (e.g., dichloromethane, chloroform, and trichloroethane), mixtures of two or more of such organic solvents, and mixtures of water and one or more of such organic solvents. The solvent is used in an amount of generally from 1 to 100 parts by weight, preferably from 5 to 50 parts by weight, per 100 parts by weight of the oxytitanyl phthalocyanine. The treatments are performed at a temperature of generally from room temperature to 100° C., preferably from 50° to 100° C. A grinding aid is used in an amount of generally from 0.5 to 200 times, preferably from 1 to 10 times, the amount of the charge generating material.

The binder resin for use in the charge generating layer 2 may be selected from a wide range of insulating resins and from organic photoconductive polymers such as poly(N-vinylcarbazole), polyvinylanthracene, polyvinylpyrene and polysilanes. Preferred examples of the binder resin include insulating resins such as poly(vinyl butyral) resins, polyarylate resins (e.g., polycondensates of bisphenol A with phthalic acid), polycarbonate resins, polyester resins, phenoxy resins, vinyl chloride-vinyl acetate copolymers, poly (vinyl acetate), polyamide resins, acrylic resins, polyacrylamide resins, polyvinylpyridine resins, cellulose resins, urethane resins, epoxy resins, casein, poly(vinyl alcohol) resins and polyvinylpyrrolidone resins. However, the binder resin should not be construed as being limited to these examples. These binder resins may be used either alone or as a mixture of two or more thereof.

The proportion (by weight) of the charge generating material to the binder resin is preferably from 10:1 to 1:10. For dispersing these ingredients, an ordinary dispersion technique employing a ball mill, attritor, sand mill or the like may be used. This dispersion treatment should be performed under such conditions that the crystal form of the charge generating material does not change. It has been ascertained that any of these dispersion techniques employed in the present invention causes no change in crystal form. It is advantageous to perform this dispersion treatment so as to reduce the particles to generally 0.5 $\mu$m or smaller, preferably 0.3 $\mu$m or smaller, particularly preferably 0.15 $\mu$m or smaller. An ordinary organic solvent may be used in the dispersion treatment of the two ingredients. Examples of the solvent include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene and xylene. These solvents may be used either alone or as a mixture of two or more thereof.

The thickness of the charge generating layer 2 used in the present invention is regulated to generally from 0.1 to 5 $\mu$m, preferably from 0.2 to 2.0 $\mu$m. For forming the charge generating layer 2, an ordinary coating technique may be used such as blade coating, wire-wound bar coating, spray coating, dip coating, bead coating, air-knife coating or curtain coating.

The charge transporting layer 3 for use in the electrophotographic photoreceptor of the present invention comprises (1) a mixture of a known charge transporting material and an appropriate binder resin, (2) a charge-transporting polymer alone, or (3) a mixture of a charge-transporting polymer and either a known charge transporting material or a binder resin.

A known charge transporting material my be used in the charge transporting layer 3. Examples thereof include oxadiazole derivatives such as 2,5-bis(p-diethylaminophenyl)1,3,4-oxadiazole, pyrazoline derivatives such as 1-[pyridyl (2)]-3-(p-diethylaminostyryl)-5-(p-diethylaminophenyl)-pyrazoline, aromatic tertiary amino compounds such as triphenylamine and dibenzylaniline, aromatic tertiary diamino compounds such as N,N'-diphenyl-N,N'-bis(3-methylphenyl)[1,1'-biphenyl]-4,4'-diamine, hydrazone derivatives such as 4-diethylaminobenzaldehyde 1,1'-diphenylhydrazone, and $\alpha$-stilbene derivatives such as p-(2,2'-diphenylvinyl)-N,N-diphenylaniline. Also usable are semiconducting polymers such as poly(N-vinylcarbazole) and derivatives thereof, polyvinylpyrene, polyvinylanthracene, polyvinylacridine, poly(9-biphenylanthracene), pyrene-formaldehyde resins, and ethylcarbazole-formaldehyde resins. However, the charge transporting material for use in the present invention should not be construed as being limited thereto. These charge transporting materials may be used either alone or as a mixture of two or more thereof.

A known resin may be used as the binder resin for the charge transporting layer 3. Examples thereof include polycarbonate resins, polyester resins, methacrylic resins, acrylic resins, poly(vinyl chloride) resins, poly(vinylidene chloride) resins, polystyrene resins, poly(vinyl acetate) resins, styrene-butadiene copolymers, vinylidene chlorideacrylonitrile copolymers, vinyl chloride-vinyl acetate copolymers, vinyl chloride-vinyl acetate-maleic anhydride copolymers, silicone resins, silicone-alkyd resins, phenolformaldehyde resins, styrene-alkyd resins and poly(N-vinylcarbazole). However, the binder resin for use in the charge transporting layer 3 should not be construed as being limited thereto. These binder resins may be used either alone or as a mixture of two or more thereof.

The proportion (by weight) of the charge transporting material to the binder resin is preferably from 10:1 to 1:5. The thickness of the charge transporting layer 3 used in the present invention is generally from 5 to 50 $\mu$m, preferably from 10 to 30 $\mu$m. For forming the charge transporting layer 3, an ordinary coating technique may be used such as blade coating, wire-wound bar coating, spray coating, dip coating, bead coating, air-knife coating or curtain coating. An ordinary organic solvent may be used in forming the charge transporting layer 3. Examples of the solvent include aromatic hydrocarbons such as benzene, toluene, xylene and chlorobenzene, ketones such as acetone and 2-butanone, halogenated aliphatic hydrocarbons such as methylene chloride, chloroform and ethylene chloride, and cyclic or linear ethers such as tetrahydrofuran and ethyl ether. These solvents may be used either alone or as a mixture of two or more thereof.

In the case where the photosensitive layer 6 has a single-layer structure, this photosensitive layer 6 comprises the charge generating material and charge transporting material each described above and a binder resin. The binder resin for use in the photosensitive layer 6 having a single-layer structure include resins for the charge transporting layer 3 described above. The proportion (by weight) of the charge transporting material to the binder resin is preferably regulated to from 1:20 to 5:1, while the proportion (by weight) of the charge generating material to the charge transporting material is preferably regulated to from 1:10 to 10:1.

Additives such as an antioxidant, a light stabilizer and a heat stabilizer may be incorporated into the photosensitive layer 6 in the electrophotographic photoreceptor of the present invention for preventing the photoreceptor from being deteriorated by the ozone or any oxidizing gas generated in the copier or by light or heat. Examples of the antioxidant include hindered phenols, hindered amines, p-phenylenediamine, arylalkanes, hydroquinone, spirochroman, spiroindanone, derivatives of these compounds, organosulfur compounds and organophosphorus compounds. Examples of the light stabilizer include benzophenone, benzotriazole, dithiocarbamates, tetramethylpiperidine and derivatives thereof. Examples of the heat stabilizer include phosphite compounds and polyhydric alcohol compounds. It is also possible to incorporate an electron-acceptor for improving sensitivity, reduction of residual potential, diminution of fatigue during repeated use, etc. Examples of electron-acceptor for use in the photoreceptor of the present invention include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Especially preferred of these are the fluorenone compound, the quinone compound, and the benzene derivatives having an electron-attracting substituent such as Cl, CN or $NO_2$. These additives each is preferably added to the photosensitive layer 6 in an amount of from 0.01 to 1 parts by weight per 10 parts by weight of the charge transporting material.

The protective layer 5 may be formed on the charge transporting layer 3 if desired and necessary. This protective layer 5 is used not only to prevent the multilayered photosensitive layer from undergoing a chemical change of the charge transporting layer 3 during charging, but also to improve the mechanical strength of the photosensitive layer 6. This protective layer 5 comprises an electrically conductive material contained in an appropriate binder resin. Examples of the electrically conductive material include metallocene compounds such as N,N'-dimethylferrocene, aromatic amine compounds such as N,N'-diphenyl-N,N'-bis (3-methylphenyl)-[1,1'-biphenyl]-4,4'-diamine, and metal oxides such as antimony oxide, tin oxide, titanium oxide, indium oxide and tin oxide-antimony oxide. However, the conductive material for use in the protective layer 5 should not be construed as being limited thereto. Examples of the binder resin for use in this protective layer 5 include known resins such as polyamide resins, polyurethane resins, polyester resins, epoxy resins, polyketone resins, polycarbonate resins, poly(vinyl ketone) resins, polystyrene resins, polyacrylamide resins, polyimide resins, poly(amide-imide) resins, and polyetherimide resins.

This protective layer 5 is preferably constituted so as to have an electrical resistivity of from $10^9$ to $10^{14}$ Ω·cm. Electrical resistivities thereof higher than $10^{14}$ Ω·cm result in an increased residual potential to give copies with considerable fogging, while electrical resistivities thereof lower than $10^9$ Ω·cm result in unsharp images with reduced resolving power. The protective layer 5 should be constituted so as not to substantially prevent transmission of the light used for image-wise exposure. The thickness of the protective layer 5 used in the present invention is desirably from 0.5 to 20 μm, preferably from 1 to 10 μm.

For forming the protective layer 5, an ordinary coating technique may be used such as blade coating, wire-wound bar coating, spray coating, dip coating, bead coating, air-knife coating or curtain coating.

The electrophotographic photoreceptor of the present invention exhibits excellent properties not only in electrophotographic apparatus employing a charging member of the conventional corona discharge type, but also in electrophotographic apparatus in which the electrophotographic photoreceptor is charged by contact electrification.

Figure 5:
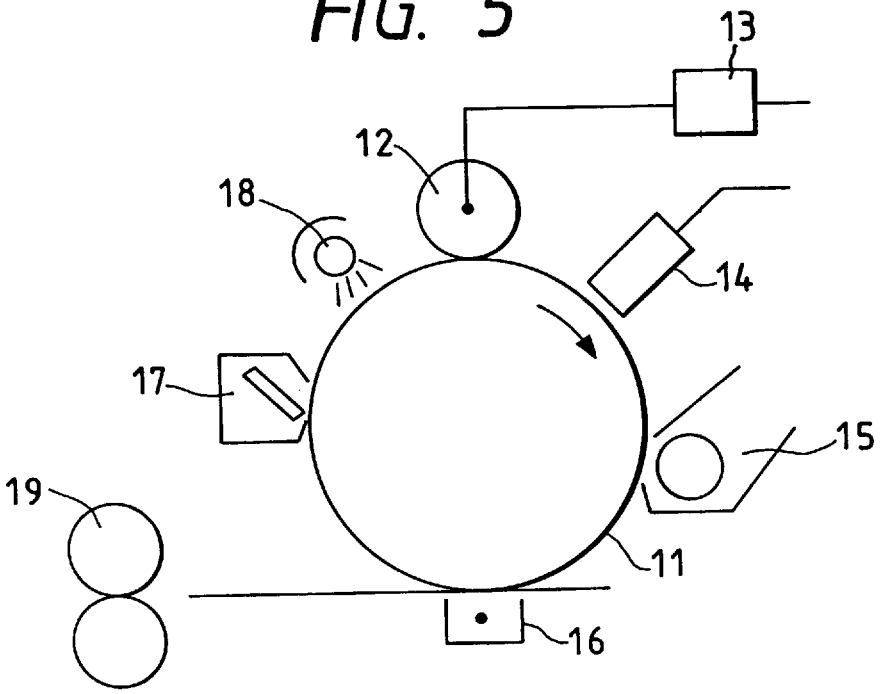
FIG. 5 is a diagrammatic view illustrating the constitution of an electrophotographic apparatus according to the present invention.
Figure 6:
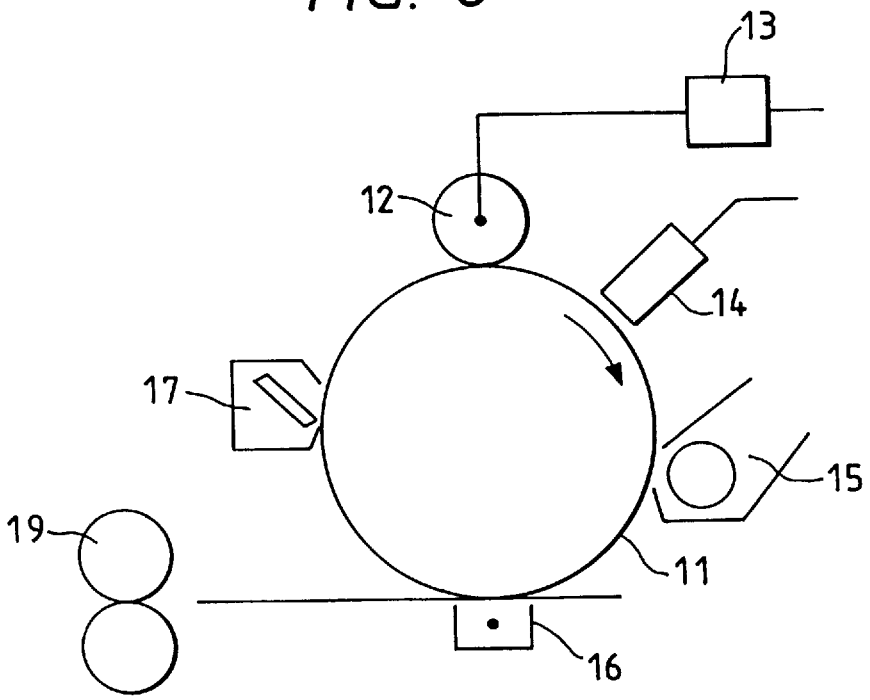
FIG. 6 is a diagrammatic view illustrating the constitution of an erase-less electrophotographic apparatus according to the present invention.

The electrophotographic apparatus of the present invention are then explained. FIG. 5 is a diagrammatic view showing the constitution of an electrophotographic apparatus according to the present invention. Reference numeral 11 denotes a photoreceptor. The apparatus has a charging member 12 disposed so as to be in contact with the photoreceptor and so that a voltage is applicable thereto from a power supply 13. Disposed around the photoreceptor are an exposure device 14, a developing device 15, a transfer device 16, a cleaning device 17, and an erase device 18. Reference numeral 19 denotes a fixing device. FIG. 6 illustrates an erase-less electrophotographic apparatus according to the present invention; this apparatus has the same structure as the electrophotographic apparatus shown in FIG. 5, except that the erase device 18 has been omitted.

The contact charging member in the above-described electrophotographic apparatus employing contact electrification is disposed so as to be in contact with the photoreceptor surface and, when a voltage is applied thereto from the power supply, it functions to uniformly charge the photoreceptor surface to a predetermined potential.

This contact charging member may be made of a metal, e.g., aluminum, iron or copper, an electrically conductive polymeric material, e.g., polyacetylene, polypyrrole or polythiophene, or a dispersion of particles of an electrically conductive substance, e.g., carbon black, copper iodide, silver iodide, zinc sulfide, silicon carbide or a metal oxide, in an elastomer material, e.g., a polyurethane rubber, silicone rubber, epichlorohydrin rubber, ethylenepropylene rubber, acrylic rubber, fluororubber, styrenebutadiene rubber or butadiene rubber. Examples of the metal oxide include ZnO, $SnO_2$, $TiO_2$, $In_2O_3$, $MoO_3$, and mixed oxides thereof. A perchloric acid salt may be incorporated into the elastomer material to impart electrical conductivity. Further, a covering layer may be formed on the surface of the charging member. Examples of materials for use in the covering layer include N-alkoxymethyl-substituted nylons, cellulose resins, vinylpyridine resins, phenolic resins, polyurethanes, poly(vinyl butyral) and melamine resins. These may be used alone or in combination. Also usable are emulsion resins, e.g., acrylic, polyester or polyurethane emulsion resins, in particular emulsion resins synthesized by soap-free emulsion polymerization. A particulate conductivity-imparting agent may be dispersed into these resins for resistivity regulation, and an antioxidant may be incorporated to prevent deterioration. It is also possible to incorporate a leveling agent or a surfactant into the emulsion resins in order to improve film-forming properties for the formation of the covering film.

The contact charging member may have any shape, e.g., a roller, blade, belt or brush shape. The resistivity of this contact charging member is preferably from $10^0$ to $10^{14}$ Ω·cm, particularly preferably from $10^2$ to $10^{12}$ Ω·cm. For applying a voltage to this contact charging member, either of direct current and alternating current or a combination of both may be used.

With respect to the exposure device, developing device, transfer device, cleaning device, and erase device, any conventionally known devices may be used.

The present invention is described in more detail with reference to the following examples, but the present invention should not be construed as being limited thereto. All the parts are by weight unless otherwise indicated.

EXAMPLE 1

A honed aluminum pipe was used as an electrically conductive support. Eight parts of the dibromoanthanthrone represented by the following structural formula (I) (Monolite Red 2Y, manufactured by Zeneca Colors) was mixed with 1 part of a poly(vinyl butyral) resin (S-LEK BM-S, manufactured by Sekisui Chemical Co., Ltd., Japan) and 20 parts of cyclohexanone. This mixture was treated with a paint shaker together with glass beads for 1 hour to disperse the pigment. To the resulting dispersion was added 1 part of acetylacetone zirconium butyrate (trade name, ZC540; manufactured by Matsumoto Chemical Industry Co., Ltd., Japan). This mixture was treated with a paint shaker for 10 minutes to prepare a coating solution.

(I)

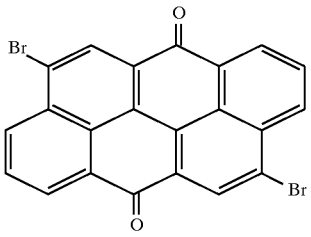

Figure 7:
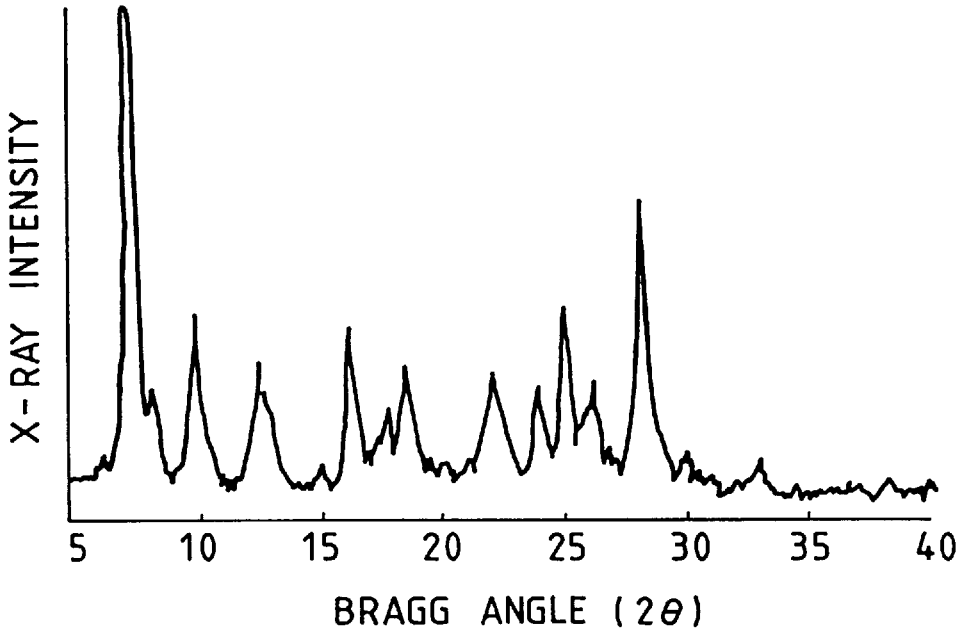
FIG. 7 is an X-ray diffraction spectrum of the hydroxygallium phthalocyanine crystal powder used in Example 1.

The coating solution thus obtained was applied to the aluminum pipe by dip coating, and the coating was dried by heating at 170° C. for 10 minutes to form an undercoat layer having a thickness of 3.0 μm. Subsequently, 0.1 part of a hydroxygallium phthalocyanine crystal powder giving the X-ray diffraction pattern shown in FIG. 7 was mixed with 0.1 part of a poly(vinyl butyral) resin (S-LEK BM-S, manufactured by Sekisui Chemical Co., Ltd.) and 10 parts of n-butyl acetate. This mixture was treated with a paint shaker together with glass beads for 1 hour to disperse the crystals. The coating solution thus obtained was applied to the undercoat layer by dip coating, and the coating was dried at 100° C. for 10 minutes to form a charge generating layer having a thickness of about 0.15 μm. It was ascertained by X-ray diffractometry that the hydroxygallium phthalocyanine crystals which had undergone the dispersion treatment had the same crystal form as the undispersed crystals.

In 20 parts of monochlorobenzene were then dissolved 2 parts of the charge transporting material represented by the following structural formula (II) and 3 parts of a polycarbonate resin made up of repeating structural units represented by formula (III). The coating solution thus obtained was applied by dip coating to the charge generating layer formed over the aluminum support, and the coating was dried by heating at 120° C. for 1 hour to form a charge transporting layer having a thickness of 20 μm.

(II)

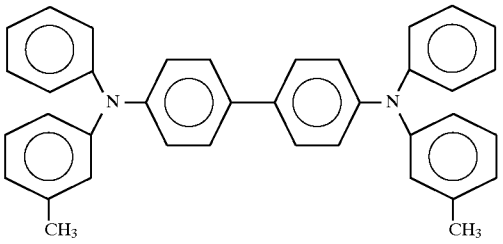

(III)

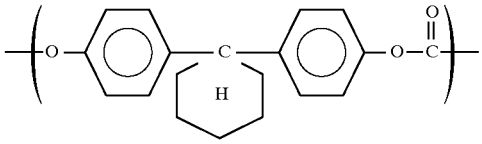

The thus-obtained electrophotographic photoreceptor was examined for electrophotographic properties as follows using a scanner obtained by modifying a laser printer (XP-15, manufactured by Fuji Xerox Co., Ltd.). In an atmosphere (1) having ordinary temperature and ordinary humidity (20° C., 40% RH), the photoreceptor was charged (A) with a scorotron charging device at an applied grid voltage of −700 V, irradiated after 1 second with 780 nm semiconductor laser light at 10.0 erg/cm$^2$ to conduct discharging (B), and irradiated after 3 seconds with red LED light at 50.0 erg/cm$^2$ to conduct charge-erasure (C). The potential of the photoreceptor was measured in each step of the above process. The higher the potential $V_H$ of the charged photoreceptor (A), the higher the potential capacity, resulting in high contrast that can be attained. The lower the potential $V_L$ of the discharged photoreceptor (B), the more the photoreceptor is sensitive. The lower the potential $V_{RP}$ of the charge-erased photoreceptor (C), the lower the residual potential and the more the photoreceptor is reduced in image memory and fogging. The above-described charging and exposure were repeated 10,000 times, following which the potential was measured in each step. The same test was also conducted in a low-temperature and low-humidity atmosphere (2) (10° C., 15% RH) and a high-temperature and high-humidity atmosphere (3) (28° C., 85% RH), and the potential changes for the respective steps ($\Delta V_H$,$\Delta V_L$, and $\Delta V_{RP}$) between atmospheres (1), (2) and (3) were determined to evaluate environmental stability with greatest change thereof. On the other hand, a drum-shaped electrophotographic photoreceptor was produced under the same conditions. This photoreceptor was mounted in a personal-computer printer (PR1000, manufactured by NEC Corporation, Japan) and subjected to a 10,000-sheet printing durability test in each of an ordinary-temperature and ordinary-humidity atmosphere (20° C., 40% RH), a low-temperature and low-humidity atmosphere (10° C., 15% RH), and a high-temperature and high-humidity atmosphere (28° C., 85% RH). The resulting image were evaluated for the occurrence of black dots caused by dielectric breakdown and for the occurrence of residual images (ghosts). The charging member used in the printer was a contact electrification type charging roll comprising a 18.8 stainless-steel shaft having a diameter of 5 mm, having an elastomer layer and a resin layer formed on its outer circumferential surface. The elastomer layer was made of a polyether-type polyurethane rubber containing a lithium perchlorate in an amount of from 0.5% by weight based on the weight of the layer for enhancing elasticity, and had been formed on the outer circumferential surface of the shaft so that the diameter of the resulting shaft is 15 mm. The resin layer as a covering layer had been formed by applying a coating solution comprising an aqueous polyester-polyurethane resin emulsion containing 0.001% methylphenyl silicone leveling agent to the elastomer layer surface by dip coating at a thickness of 20 μm on a dry basis and drying the coating at 120° C. for 20 minutes. The results obtained are shown in Table 1.

EXAMPLE 2

An electrophotographic photoreceptor was produced and evaluated in the same manner as in Example 1, except that the organometallic compound in the undercoat layer in Example 1 was replaced with the same parts of titanium acetylacetonate (Orgatics TC100, manufactured by Matsumoto Chemical Industry Co., Ltd.). The results obtained are shown in Table 1.

EXAMPLE 3

An electrophotographic photoreceptor was produced and evaluated in the same manner as in Example 1, except that the electron-transporting pigment in the undercoat layer in Example 1 was replaced with the same parts of a mixture of the benzimidazoleperylene pigments represented by the following structural formulae (IV-1) and (IV-2). The results obtained are shown in Table 1.

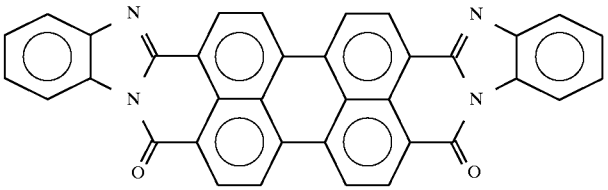

(IV-1)

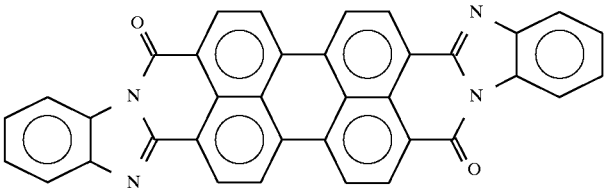

(IV-2)

EXAMPLE 4

An electrophotographic photoreceptor was produced and evaluated in the same manner as in Example 1, except that the electron-transporting pigment in the undercoat layer in Example 1 was replaced with the same parts of the bisazo pigment represented by the following structural formula (V). The results obtained are shown in Table 1.

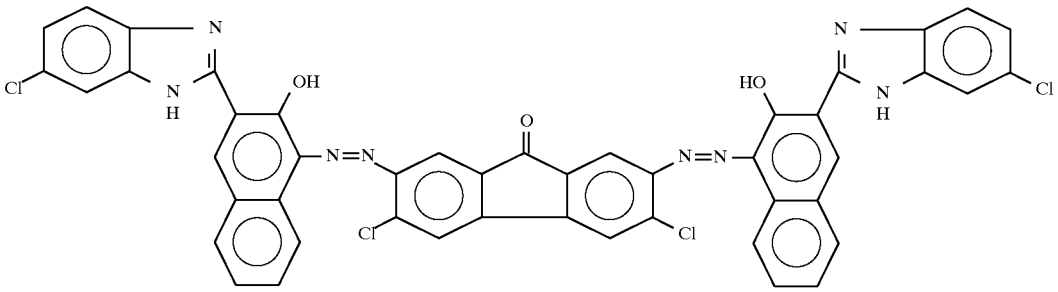

(V)

EXAMPLE 5

An electrophotographic photoreceptor was produced and evaluated in the same manner as in Example 1, except that the electron-transporting pigment in the undercoat layer in Example 1 was replaced with the same parts of the bisazo pigment represented by the following structural formula (VI). The results obtained are shown in Table 1.

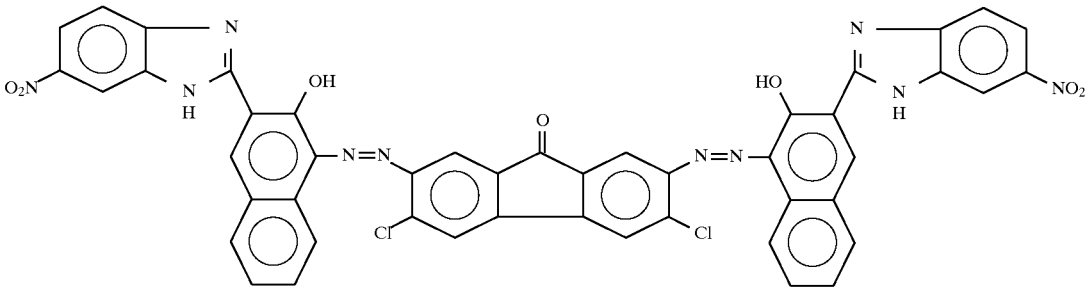

(VI)

EXAMPLE 6

An electrophotographic photoreceptor was produced and evaluated in the same manner as in Example 1, except that the binder resin in the undercoat layer in Example 1 was replaced with the same parts of a poly(vinyl butyral) resin (S-LEK BM-1,manufactured by Sekisui Chemical Co., Ltd.). The results obtained are shown in Table 1.

EXAMPLE 7

An electrophotographic photoreceptor was produced and evaluated in the same manner as in Example 1, except that the binder resin in the undercoat layer in Example 1 was replaced with the same parts of a polyester resin (trade name, Vylon 200; manufactured by Toyobo Co., Ltd., Japan). The results obtained are shown in Table 1.

EXAMPLE 8

An electrophotographic photoreceptor was produced and evaluated in the same manner as in Example 1, except that 0.5 parts by weight of γ-aminopropyltrimethoxysilane (A-1100, manufactured by Nippon Unicar Co., Ltd., Japan) was further added to the undercoat layer. The results obtained are shown in Table 1.

EXAMPLE 9

Figure 8:
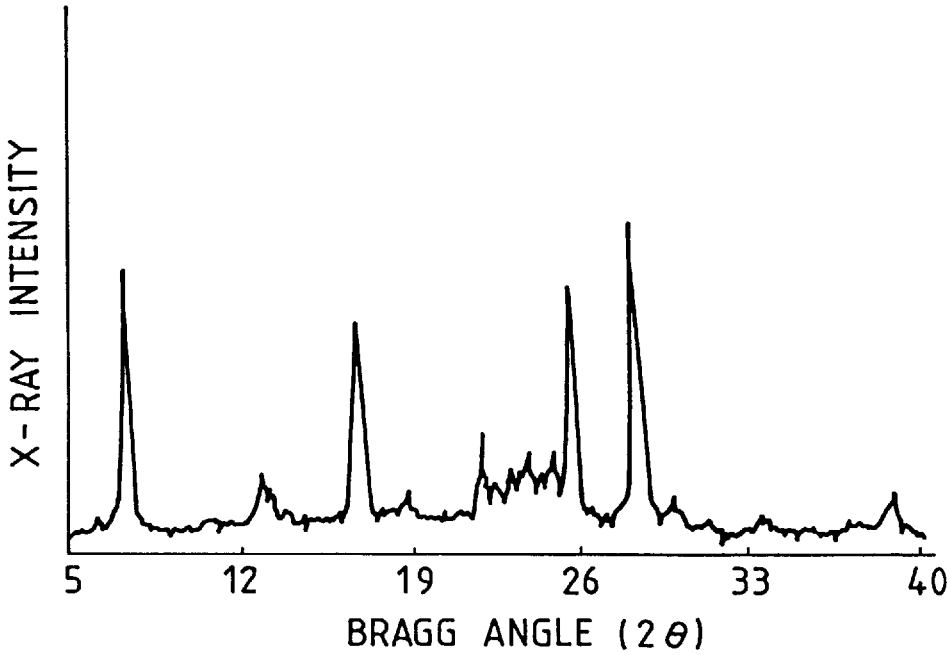
FIG. 8 is an X-ray diffraction spectrum of the chlorogallium phthalocyanine crystal powder used in Example 9.

An electrophotographic photoreceptor was produced and evaluated in the same manner as in Example 1, except that the charge generating material used in Example 1 was replaced with the same parts of a chlorogallium phthalocyanine crystal powder giving the X-ray diffraction spectrum shown in FIG. 8. The results obtained are shown in Table 1.

EXAMPLE 10

Figure 9:
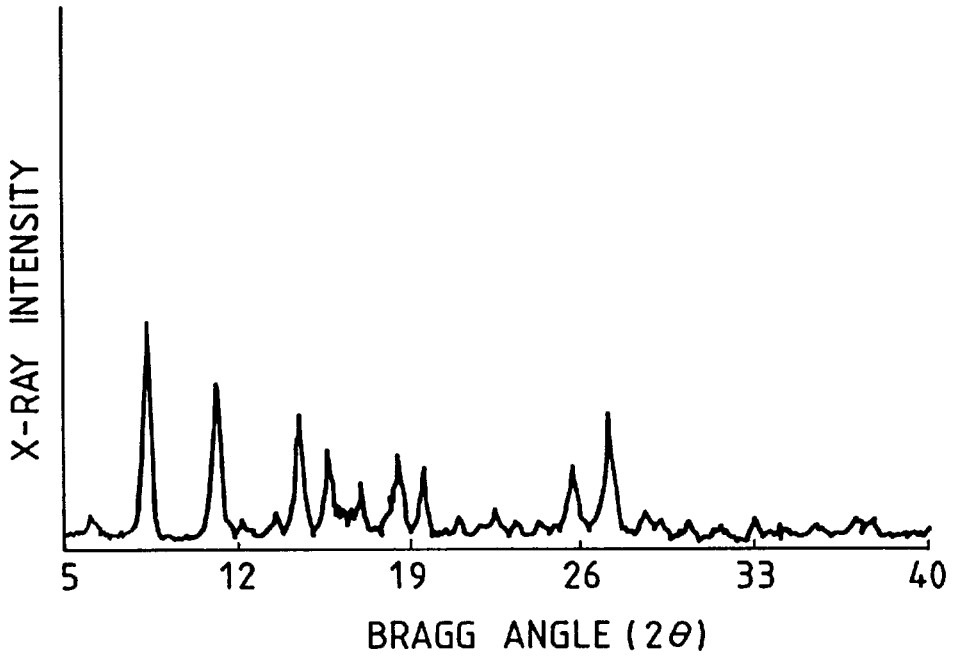
FIG. 9 is an X-ray diffraction spectrum of the dichlorotin phthalocyanine crystal powder used in Example 10.

An electrophotographic photoreceptor was produced and evaluated in the same manner as in Example 1, except that the charge generating material used in Example 1 was replaced with the same parts of a dichlorotin phthalocyanine crystal powder giving the X-ray diffraction spectrum shown in FIG. 9. The results obtained are shown in Table 1.

EXAMPLE 11

Figure 10:
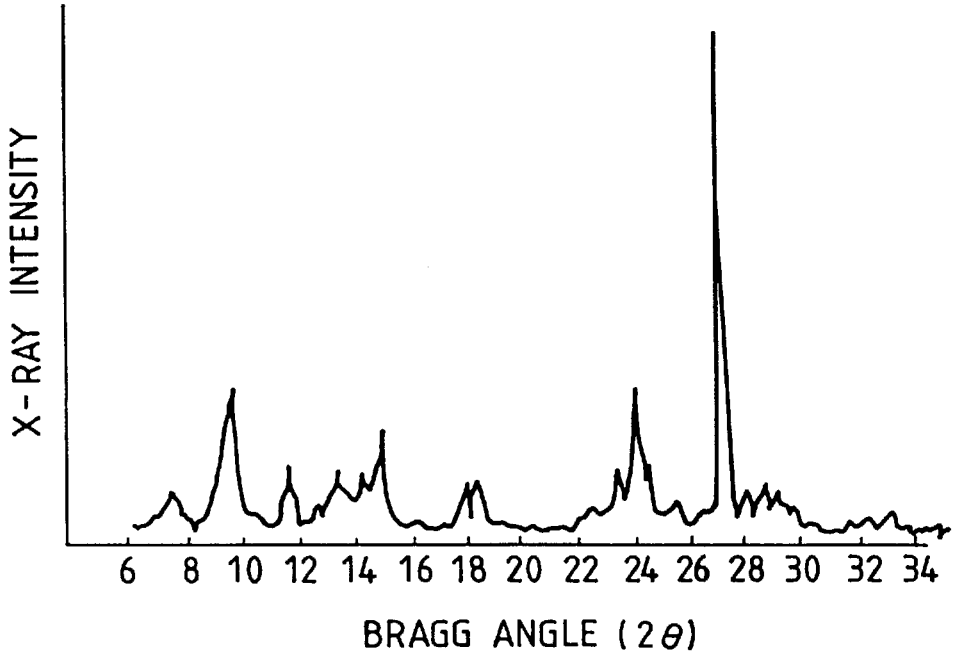
FIG. 10 is an X-ray diffraction spectrum of the titanyl phthalocyanine crystal powder used in Example 11.

An electrophotographic photoreceptor was produced and evaluated in the same manner as in Example 1, except that the charge generating material used in Example 1 was replaced with the same parts of a titanyl phthalocyanine crystal powder giving the X-ray diffraction spectrum shown in FIG. 10. The results obtained are shown in Table 1.

EXAMPLE 12

An electrophotographic photoreceptor was produced and evaluated in the same manner as in Example 1, except that the electron-transporting pigment in the undercoat layer in Example 1 was replaced with the same parts of the phthalocyanine pigment represented by structural formula (VII). The results obtained are shown in Table 1.

(VII)

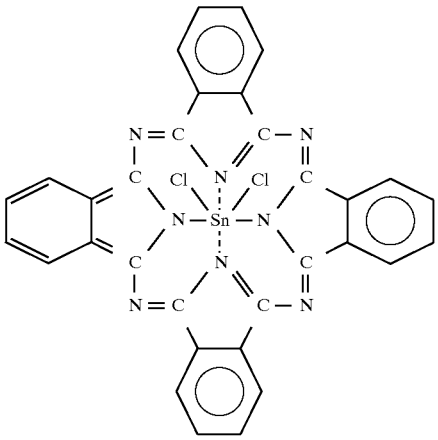

Comparative Example 1

An electrophotographic photoreceptor was produced and evaluated in the same manner as in Example 1, except that the coating solution for an undercoat layer in Example 1 was replaced with a solution in methanol/butanol (2/1 by weight) of an 8-nylon resin (Luckamide 5003, manufactured by Dainippon Ink & Chemicals, Inc., Japan) to form an undercoat layer having the same thickness as that of the undercoat layer in Example 1. The results obtained are shown in Table 1.

Comparative Example 2

An electrophotographic photoreceptor was produced and evaluated in the same manner as in Comparative Example 1, except that the coating solution for an undercoat layer in Comparative Example 1 was replaced with a solution of a quadripolymer nylon resin (CM8000, manufactured by Toray Industries, Inc., Japan) to form an undercoat layer having the same thickness as that of the undercoat layer in Comparative Example 1. The results obtained are shown in Table 1.

Comparative Example 3

An electrophotographic photoreceptor was produced in the same manner as in Comparative Example 1, except that the coating solution for an undercoat layer was replaced with a dispersion prepared by mixing 8 parts of dibromoanthanthrone, 1 part of a poly(vinyl butyral) resin and 20 parts of cyclohexanone. The undercoat layer suffered dissolution during the coating operation for forming the charge generating layer, so that the electrophotographic photoreceptor obtained was unusable.

Furthermore, the photoreceptors obtained in Comparative Examples 1 and 2 were subjected to the same image evaluation test as the above, except that the personal-computer printer was modified by replacing the charging member with a scorotron and mounting an erase device therein so as to give the same photoreceptor surface potential. As a result, neither black dots caused by discharge breakdown nor ghosts occurred.

TABLE 1

| | Initial Potential | | | Potential after 10,000 Repetitions | | | Environmental Stability | | | Printing Durability Test Occurrence of black | Printing Test |
|---|---|---|---|---|---|---|---|---|---|---|---|
| Example No. | A $V_H$(V) | B $V_L$(V) | C $V_{RP}$(V) | A $V_H$(V) | B $V_L$(V) | C $V_{RP}$(V) | A $V_H$(V) | B $V_L$(V) | C $V_{RP}$(V) | dots by breakdown | Occurrence of ghosts |
| Ex. 1 | −700 | −20 | −5 | −695 | −20 | −5 | 15 | 10 | 5 | none | none |
| Ex. 2 | −710 | −15 | −5 | −695 | −15 | −5 | 10 | 10 | 10 | none | none |
| Ex. 3 | −695 | −15 | −10 | −680 | −15 | −10 | 10 | 15 | 5 | none | none |
| Ex. 4 | −700 | −15 | −5 | −690 | −15 | −10 | 10 | 10 | 10 | none | none |
| Ex. 5 | −690 | −20 | −10 | −680 | −15 | −10 | 15 | 10 | 10 | none | none |
| Ex. 6 | −705 | −20 | −15 | −690 | −20 | −10 | 15 | 10 | 10 | none | none |
| Ex. 7 | −700 | −25 | −10 | −685 | −20 | −15 | 20 | 10 | 15 | none | none |
| Ex. 8 | −700 | −20 | −5 | −695 | −20 | −5 | 15 | 10 | 5 | none | none |
| Ex. 9 | −690 | −60 | −20 | −680 | −60 | −20 | 20 | 15 | 10 | none | none |
| Ex. 10 | −695 | −100 | −15 | −680 | −100 | −20 | 20 | 10 | 5 | none | none |
| Ex. 11 | −710 | −20 | −10 | −700 | −20 | −15 | 30 | 50 | 50 | none | none |

TABLE 1-continued

| | Initial Potential | | | Potential after 10,000 Repetitions | | | Environmental Stability | | | Printing Durability Test Occurrence of black | Printing Test |
|---|---|---|---|---|---|---|---|---|---|---|---|
| Example No. | A $V_H$(V) | B $V_L$(V) | C $V_{RP}$(V) | A $V_H$(V) | B $V_L$(V) | C $V_{RP}$(V) | A $V_H$(V) | B $V_L$(V) | C $V_{RP}$(V) | dots by breakdown | Occurrence of ghosts |
| Ex. 12 | −695 | −20 | −5 | −700 | −25 | −15 | 20 | 15 | 10 | none | none |
| Comp. Ex. 1 | −685 | −150 | −50 | −665 | −170 | −80 | 60 | 100 | 80 | occurred | occurred |
| Comp. Ex. 2 | −670 | −140 | −55 | −660 | −160 | −70 | 50 | 120 | 70 | occurred | occurred |

As apparent from the results of the examples given above, since the electrophotographic photoreceptor of the present invention has an undercoat layer comprising an electron-transporting pigment and an organometallic compound, the photoreceptor not only is excellent in environmental stability, long-term durability, and resistance to dielectric breakdown caused by contact electrification, but also does not cause ghosts when used in an erase-less electrophotographic apparatus.

While the invention has been described in detail and with reference to specific examples thereof, it will be apparent to one skilled in the art that various changes and modification can be made therein without departing from the spirit and scope thereof.

What is claimed is:

1. An electrophotographic apparatus comprising:

a negative-electrification electrophotographic photoreceptor comprising an electrically conductive support having thereon an undercoat layer and a photosensitive layer, wherein said undercoat layer comprises an electron-transporting pigment and a chemical product of a hydrolysis reaction of a reactive organometallic compound, said electron-transporting pigment comprising at least one member selected from the group consisting of a polycyclic quinone pigment, a perylene pigment, an azo pigment, a phthalocyanine pigment, an indigo pigment and a quinacridone pigment;

a charging member disposed so as to be in contact with said photoreceptor and which charges the photoreceptor upon application of a voltage to the charging member; and an erase device.

2. The electrophotographic apparatus as claimed in claim 1, wherein said photosensitive layer is a multilayered photosensitive layer comprising a charge generating layer and a charge transporting layer to allot functions of said photosensitive layer thereto.

3. The electrophotographic apparatus as claimed in claim 1, wherein said undercoat layer further comprises a binder resin.

4. The electrophotographic apparatus as claimed in claim 1, wherein said polycyclic quinone pigment is a brominated anthanthrone.

5. The electrophotographic apparatus as claimed in claim 1, wherein said perylene pigment is represented by at least one of structural formulae (1) and (2).

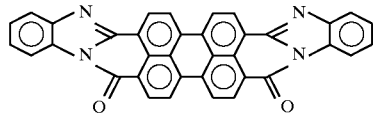

(1)

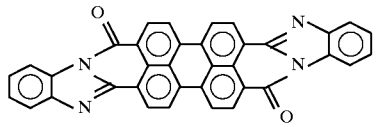

(2)

6. The electrophotographic apparatus as claimed in claim 1, wherein said phthalocyanine pigment is represented by the following structural formula (3).

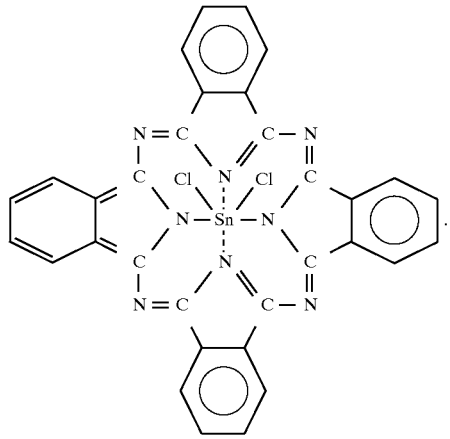

(3)

7. The electrophotographic apparatus as claimed in claim 1, wherein said reactive organometallic compound comprises at least one member selected from the group consisting of a zirconium alkoxide compound, a zirconium chelate compound, a titanium alkoxide compound and a titanium chelate compound.

8. The electrophotographic apparatus as claimed in claim 1, wherein said undercoat layer further comprises a silane coupling agent.

9. The electrophotographic apparatus as claimed in claim 1, wherein a proportion of the electron-transporting pigment to the organometallic compound is from 1:0.01 to 1:1 parts by weight.

10. The electrophotographic apparatus as claimed in claim 1, wherein the apparatus further comprises an exposure device, a developing device, a transfer device and a cleaning device disposed around the photoreceptor.

11. An erase-less electrophotographic apparatus comprising:

a negative-electrification electrophotographic photoreceptor comprising an electrically conductive support having thereon an undercoat layer and a photosensitive layer, wherein said undercoat layer comprises an electron-transporting pigment and a chemical product of a hydrolysis reaction of a reactive organometallic compound, said electron-transporting pigment comprising at least one member selected from the group consisting of a polycyclic quinone pigment, a perylene pigment, an azo pigment, a phthalocyanine pigment, an indigo pigment and a quinacridone pigment; and a charging member disposed so as to be in contact with said photoreceptor and which charges the photoreceptor upon application of a voltage to the charging member.

12. The erase-less electrophotographic apparatus as claimed in claim 11, wherein said photosensitive layer is multilayered photosensitive layer comprising a charge generating layer and a charge transporting layer to allot functions of said photosensitive layer thereto.

13. The erase-less electrophotographic apparatus as claimed in claim 11, wherein said undercoat layer further comprises a binder resin.

14. The erase-less electrophotographic apparatus as claimed in claim 11, wherein said polycyclic quinone pigment is a brominated anthanthrone.

15. The erase-less electrophotographic apparatus as claimed in claim 11, wherein said apparatus as claimed in claim 12, wherein said perylene pigment is represented by at least one of structural formulae (1) and (2)

(VII)

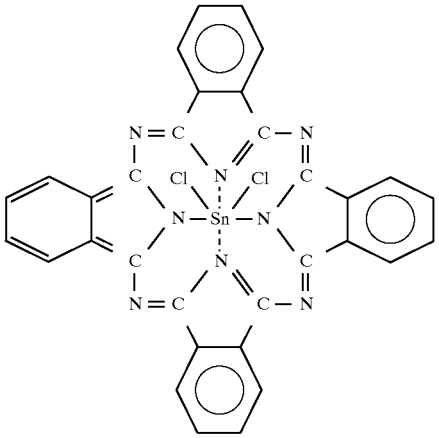

16. The erase-less electrophotographic apparatus as claimed in claim 11, wherein said phthalocyanine pigment is represented by the following structural formula (3)

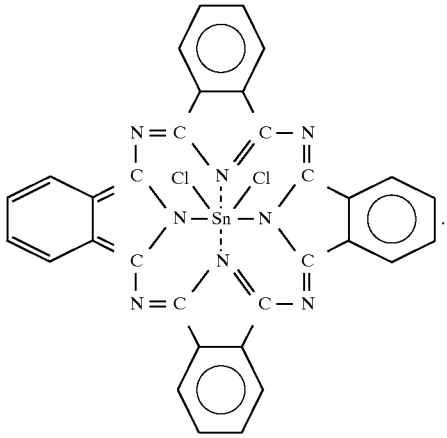

17. The erase-less electrophotographic apparatus as claimed in claim 11, wherein said reactive organometallic compound comprises at least one member selected from the group consisting of a zirconium alkoxide compound, a zirconium chelate compound, a titanium alkoxide compound and a titanium chelate compound.

18. The erase-less electrophotographic apparatus as claimed in claim 11, wherein said undercoat layer further comprises a silane coupling agent.

19. The erase-less electrophotographic apparatus as claimed in claim 11, wherein a proportion of the electron-transporting pigment to the organometallic compound is from 1:0.01 to 1:1 parts by weight.

20. The erase-less electrophotographic apparatus as claimed in claim 11, wherein the apparatus further comprises an exposure device, a developing device, a transfer device, and a cleaning device disposed around the photoreceptor.

* * * * *